US010342289B2

(12) United States Patent
Bell

(10) Patent No.: US 10,342,289 B2
(45) Date of Patent: Jul. 9, 2019

(54) WOVEN PLANAR FOOTWEAR UPPER

(71) Applicant: Nike, Inc., Beaverton, OR (US)

(72) Inventor: Thomas G. Bell, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/139,262

(22) Filed: Dec. 23, 2013

(65) Prior Publication Data

US 2014/0173934 A1 Jun. 26, 2014

Related U.S. Application Data

(60) Provisional application No. 61/745,269, filed on Dec. 21, 2012.

(51) Int. Cl.

| | |
|---|---|
| ***A43B 23/02*** | (2006.01) |
| ***A43B 13/02*** | (2006.01) |
| ***A43B 1/04*** | (2006.01) |
| ***D03D 13/00*** | (2006.01) |
| ***D03D 15/08*** | (2006.01) |

(Continued)

(52) U.S. Cl.

CPC ..... *A43B 13/02* (2013.01); *A43B 1/04* (2013.01); *A43B 23/02* (2013.01); *A43B 23/027* (2013.01); *A43B 23/0225* (2013.01); *A43B 23/0265* (2013.01); *A43B 23/0275* (2013.01); *A43B 23/042* (2013.01); *A43C 11/002* (2013.01); *D03D 13/002* (2013.01); *D03D 15/08* (2013.01); *D10B 2501/043* (2013.01)

(58) Field of Classification Search

CPC ..... D03D 5/08; D03D 3/00; D10B 2501/043; A43B 1/04; A43B 13/02; A43B 23/0225; A43B 23/0235; A43B 23/0205; A43B 23/0295; A43B 23/04; A43B 23/042

See application file for complete search history.

(56) References Cited

U.S. PATENT DOCUMENTS 625,423 A * 5/1899 Scriven ..... A41B 9/04 2/401
2,147,197 A 2/1939 Glidden (Continued)

FOREIGN PATENT DOCUMENTS

CN 1067566 A 1/1993
CN 102271548 A 12/2011

(Continued)

OTHER PUBLICATIONS

International Search Report and Written Opinion dated May 6, 2014 in PCT/US2013/077549, 7 pages.

(Continued)

*Primary Examiner* — Katharine Gracz

(74) *Attorney, Agent, or Firm* — Shook Hardy & Bacon, LLP

(57) ABSTRACT

Aspects of the present invention relate to a shoe upper that is formed as a substantially planar article with varied functional zones integrated therein. The varied functional zones may be strategically positioned zones having varied degrees of stretch. Additionally, it is contemplated that the functional zones may provide dimensional variation (e.g., thickness) and/or permeability (e.g., breathability) characteristics. The substantially planar upper may then be formed into a three-dimensional upper having a volume that may be occupied by a wearer's foot.

20 Claims, 12 Drawing Sheets

(51) Int. Cl.
*A43B 23/04* (2006.01)
*A43C 11/00* (2006.01)

(56) References Cited

U.S. PATENT DOCUMENTS

| | | | | |
|---|---|---|---|---|
| 3,213,893 | A | 10/1965 | Bellmore | |
| 3,234,972 | A | 2/1966 | Koppelman et al. | |
| 3,427,673 | A | 2/1969 | Freer | |
| 3,583,081 | A | 6/1971 | Hayashi | |
| 3,669,158 | A | 6/1972 | Phillips | |
| 4,232,458 | A | 11/1980 | Bartels | |
| 4,559,722 | A * | 12/1985 | Norton | A43B 5/06 36/105 |
| 4,756,098 | A | 7/1988 | Boggia | |
| 5,187,883 | A | 2/1993 | Penney | |
| 5,345,638 | A * | 9/1994 | Nishida | A41H 3/08 12/146 C |
| 5,351,722 | A | 10/1994 | Mamiliano | |
| 5,377,430 | A * | 1/1995 | Hatfield | A43B 3/08 24/714.6 |
| 5,784,806 | A | 7/1998 | Wendt | |
| 5,896,758 | A | 4/1999 | Rock et al. | |
| 6,029,376 | A | 2/2000 | Cass | |
| 6,074,965 | A | 6/2000 | Bodenschatz et al. | |
| 6,299,962 | B1 | 10/2001 | Davis | |
| 6,588,124 | B2 * | 7/2003 | Morrone | A43B 5/12 12/142 G |
| 6,696,122 | B1 | 2/2004 | Deschamps | |
| 6,910,288 | B2 | 6/2005 | Dua | |
| 7,051,460 | B2 | 5/2006 | Orei et al. | |
| 7,204,042 | B2 | 4/2007 | Aveni | |
| 7,290,357 | B2 | 11/2007 | McDonald et al. | |
| 7,484,539 | B1 | 2/2009 | Huang | |
| 7,637,032 | B2 | 12/2009 | Sokolowski et al. | |
| 7,836,917 | B1 | 11/2010 | Osborne | |
| 7,836,918 | B1 | 11/2010 | Osborne | |
| 7,841,369 | B1 | 11/2010 | Osborne | |
| 8,402,674 | B2 | 3/2013 | Sandy | |
| 8,490,299 | B2 | 7/2013 | Dua et al. | |
| 8,814,429 | B2 | 8/2014 | Roether et al. | |
| 2002/0078591 | A1 * | 6/2002 | Morrone | A43B 5/12 36/8.3 |
| 2004/0181972 | A1 | 9/2004 | Csorba | |
| 2005/0011576 | A1 | 1/2005 | Dini | |
| 2005/0193592 | A1 | 9/2005 | Dua et al. | |
| 2005/0208857 | A1 | 9/2005 | Baron et al. | |
| 2006/0059715 | A1 | 3/2006 | Aveni | |
| 2006/0162190 | A1 * | 7/2006 | Nishiwaki | A43B 5/10 36/97 |
| 2007/0010394 | A1 | 1/2007 | Atsushi et al. | |
| 2007/0034277 | A1 | 2/2007 | Takai | |
| 2007/0043630 | A1 | 2/2007 | Lyden | |
| 2008/0083138 | A1 * | 4/2008 | Lacorazza | A43B 3/26 36/97 |
| 2008/0110048 | A1 | 5/2008 | Dua et al. | |
| 2008/0128099 | A1 | 6/2008 | Amrani | |
| 2009/0107012 | A1 | 4/2009 | Cheney et al. | |
| 2010/0018075 | A1 | 1/2010 | Meschter et al. | |
| 2010/0037483 | A1 | 2/2010 | Meschter et al. | |
| 2010/0154256 | A1 | 6/2010 | Dua | |
| 2010/0223808 | A1 | 9/2010 | Sandy | |
| 2010/0251564 | A1 | 10/2010 | Meschter | |
| 2011/0041359 | A1 | 2/2011 | Dojan et al. | |
| 2011/0088282 | A1 * | 4/2011 | Dojan | A43B 23/0235 36/45 |
| 2011/0088285 | A1 | 4/2011 | Dojan et al. | |
| 2011/0113648 | A1 | 5/2011 | Leick et al. | |
| 2011/0113650 | A1 | 5/2011 | Hurd et al. | |
| 2012/0011744 | A1 * | 1/2012 | Bell | A43B 1/0072 36/91 |
| 2012/0198727 | A1 | 8/2012 | Long | |
| 2012/0233882 | A1 | 9/2012 | Huffa et al. | |
| 2012/0246973 | A1 | 10/2012 | Dua | |
| 2013/0047467 | A1 | 2/2013 | Roether et al. | |
| 2013/0125420 | A1 * | 5/2013 | Raghuprasad | A43B 3/26 36/97 |
| 2013/0160323 | A1 * | 6/2013 | Hsiao | A43B 3/248 36/45 |
| 2015/0237960 | A1 | 8/2015 | Mallen et al. | |

FOREIGN PATENT DOCUMENTS

| | | | |
|---|---|---|---|
| CN | 102762121 | A | 10/2012 |
| DE | 627878 | C | 7/1936 |
| EP | 1553220 | A1 | 7/2005 |
| EP | 2811056 | A1 | 2/2014 |
| KR | 2012006082 | A | 6/2012 |
| KR | 1020120066000 | A | 6/2012 |
| WO | 0121870 | A1 | 3/2001 |
| WO | 2004105941 | A1 | 12/2004 |
| WO | 2007050111 | A2 | 5/2007 |
| WO | 2009006934 | A1 | 1/2009 |

OTHER PUBLICATIONS

International Search Report and Written Opinion dated May 6, 2014 in PCT/US2013/077551, 7 pages.
International Preliminary Report on Patentability dated Jul. 2, 2015 in PCT/US2013/077549, 6 pages.
International Preliminary Report on Patentability dated Jul. 2, 2015 in PCT/US2013/077550, 6 pages.
International Preliminary Report on Patentability dated Jul. 2, 2015 in PCT/US2013/077551, 6 pages.
International Search Report and Written Opinion, in PCT/US2013/077550, dated May 6, 2014, 12 pages.
Wikipedia: "Young's modulus", Internet—Wikipedia , Dec. 13, 2012 (Dec. 13, 2012), Retrieved from the Internet: URL:https://en.wikipedia.org/w/index.php?title=Young cY027smodulus&oldid=527797141 [retrieved on Jun. 5, 2016].
European Search Report dated Jul. 8, 2016 for European Patent Application No. 13864303.66, 11 pages.
European Search Report dated Jul. 8, 2016 for European Patent Application No. 13864224.4, 15 pages.
European Search Report dated Jul. 11, 2016 for European Patent Application No. 13864525.4, 12 pages.
Non-Final Office Action dated Oct. 20, 2016 in U.S. Appl. No. 14/139,255, 15 pages.
Non-Final Office Action dated Dec. 1, 2016 in U.S. Appl. No. 13/779,084, 22 pages.
Non-Final Office Action dated Dec. 18, 2015 in U.S. Appl. No. 13/779,084, 10 pages.
Final Office Action dated Apr. 25, 2016 in U.S. Appl. No. 13/779,084, 16 pages.
Non-Final Office Action dated Jul. 13, 2016 in U.S. Appl. No. 14/139,245, 16 pages.
Final Office Action dated Jul. 25, 2017 in U.S. Appl. No. 14/139,255, 16 pages.
Office Action dated Nov. 14, 2017 in European Patent Application No. 13864525.4, 6 pages.
Office Action dated Nov. 23, 2017 in European Patent Application No. 13864224.4, 7 pages.
Office Action dated Nov. 24, 2017 in European Patent Application No. 13864303.6, 6 pages.
Final Office Action dated Apr. 20, 2017 in U.S. Appl. No. 14/139,245, 19 pages.
Communication Pursuant to Article 94(3) EPC dated Jun. 28, 2018 in European Application No. 13864525.4, 4 pages.
Communication under Rule 71(3) dated Oct. 8, 2018 in European Patent Application No. 13864303.6, 59 pages.
Communication under Rule 71(3) dated Oct. 17, 2018 in European Patent Application No. 13864525.4, 60 pages.
Decision to grant a European patent pursuant to Article 97(1) dated Jan. 7, 2019 in European Patent Application No. 13864224.4, 2 pages.
Decision to grant a European patent pursuant to Article 97(1) dated Feb. 14, 2019 in European Patent Application No. 13864303.6 2 pages.

(56) References Cited

OTHER PUBLICATIONS

Decision to grant a European patent pursuant to Article 97(1) dated Feb. 21, 2019 in European Patent Application No. 13864525.4, 2 pages.

* cited by examiner

WOVEN PLANAR FOOTWEAR UPPER

CROSS-REFERENCE TO RELATED APPLICATION

This application claims the benefit of U.S. Provisional Application No. 61/745,269, filed Dec. 21, 2012, and entitled "Woven Footwear Upper."

BACKGROUND

The manufacturing of a shoe upper may involve sewing and adhering a number of physically discrete pieces to result in a three-dimensional volume able to receive a wearer's foot. The manufacturing resources utilized to cut and secure the individual portions can be costly and detrimental to the resulting quality of the shoe upper. Even though the incorporation of multiple physically discrete pieces may increase the burden on resource, the various discrete pieces may be utilized in the shoe upper to impart desired physical characteristics to the shoe upper.

SUMMARY

Aspects of the present invention relate to a shoe upper that is formed as a substantially planar article with varied functional zones integrally formed therein. The varied functional zones may be strategically positioned zones having varied degrees of stretch. Additionally, it is contemplated that the functional zones may provide dimensional variation (e.g., thickness) and/or permeability (e.g., breathability) characteristics. The substantially planar upper may then be formed into a three-dimensional upper having a volume that may be occupied by a wearer's foot. The upper having integrally formed functional zones may be formed in a single weaving operation that integrates the various functional zones in a common manufacturing process without utilizing post-processing coupling techniques to integrate the functional zones.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Aspects of the present invention relate to a shoe upper that is formed as a flat article with varied functional zones integrated therein. For example, it is contemplated that a substantially planar shoe upper is produced on a loom with strategically positioned zones having varied degrees of stretch. Additionally, it is contemplated that the functional zones may provide dimensional variation (e.g., thickness) and/or permeability (e.g., breathability) characteristics. The substantially planar upper may then be formed into a three-dimensional upper having a volume that may be occupied by a wearer's foot. The upper having integrally formed functional zone may be formed in a single weaving operation that integrates the various functional zones in a common manufacturing process without utilizing post-processing coupling techniques to integrate the functional zones.

Figure 1:
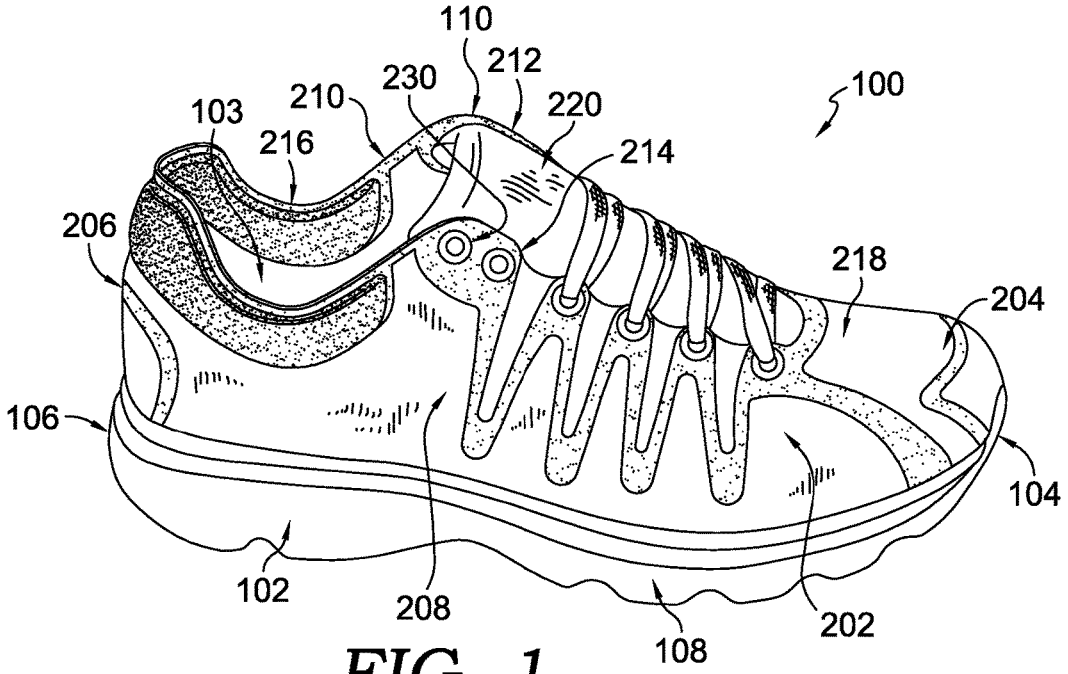
FIG. 1 depicts a shoe comprised of a multi-zoned substantially-planar unitary upper in an as-worn position, in accordance with aspects of the present invention.

FIG. 1 depicts a shoe 100 comprised of a multi-zoned substantially-planar unitary upper 202 in an as-worn position, in accordance with aspects of the present invention. The construction of the shoe 100 of the present invention has the basic construction of an athletic-type shoe. However, it should be understood that the novel concept of the invention could be employed on other types of footwear. Therefore, while the term "shoe" will be used herein, any type of footwear is contemplated for any purpose such that the term "shoe" should be interpreted herein as "footwear." Because much of the construction of the shoe 100 is the same as that of a conventional athletic shoe, the conventional features of the constructions will be described only generally herein. Additionally, relative location terminology will be utilized herein. For example, the term "proximate" is intended to mean on, about, near, by, next to, at, and the like. Therefore, when a feature is proximate another feature, it is close in proximity but not necessarily exactly at the describe location, in some aspects.

The shoe 100 has a shoe sole 102 that is constructed of resilient materials that are typically employed in the construction of soles of athletic shoes. The sole 102 can be constructed with an outsole, a midsole, and an insert, as is conventional. The shoe sole 102 has a bottom surface that functions as the traction surface of the shoe, and an opposite top. The size of the shoe 100 has a length that extends from a rear sole heel end 106 to a front toe end 104 of the sole 102. The sole 102 has a width that extends between a medial side 110 and a lateral side 108 of the sole 102.

The shoe 100 also is constructed with an upper 202. The upper 202 is secured to the sole 102 and extends upwardly from the shoe sole, such as the sole top surface. The upper 202 is constructed of a flexible material, such as a woven or knit material. The woven or knit material may be formed with a combination of materials. For example, synthetic materials, such as nylon, polyester, acrylic, carbon fibers, aramids, and other synthetic materials may be utilized in the forming of at least a portion of the upper 202. Similarly, it is contemplated that natural materials, such as cotton, wool, bamboo, soy-based, corn-based, and other natural materials may be utilized in the forming of at least a portion of the upper 202. Further, it is contemplated that multi-component materials may be utilized in the construction of a portion of the upper 202. As will be discussed hereinafter, it is contemplated that combinations of materials may be utilized in various regions of the upper 202 to form functional regions/zones in a substantially planar upper being formed through weaving or knitting techniques. As also will be discussed, varied manufacturing techniques may be implemented in specific zones of the upper 202 to achieve strategic variations in functional qualities at particular locations of the upper 202.

The upper 202 is constructed with a heel portion 206 that extends around the sole 102 at the sole heel end 106. The upper heel portion 206 extends upwardly from the shoe sole 102 to an ankle edge 261 defining, in part, an ankle opening 216. The ankle opening 216 provides access to the shoe interior.

Figure 2:
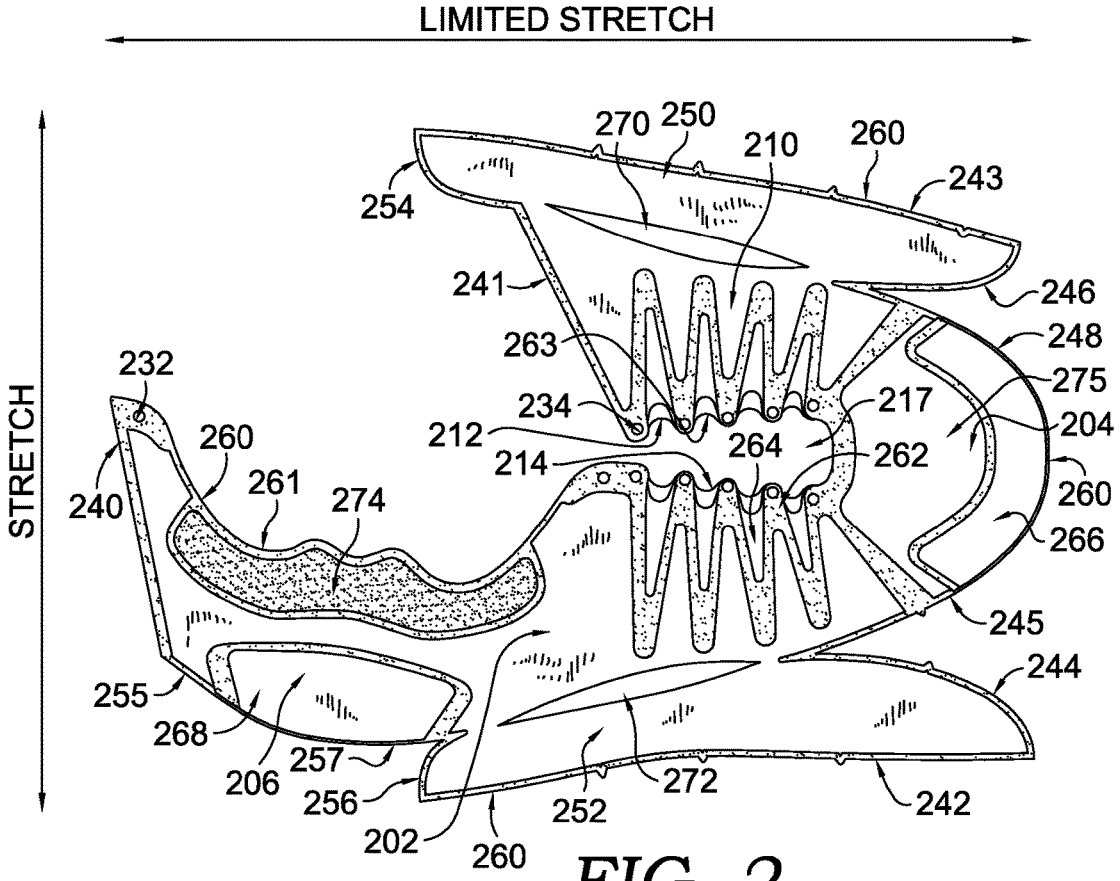
FIG. 2 depicts the upper in a substantially planar orientation, in accordance with aspects of the present invention.

From the heel portion 206, the upper 202 has a medial side portion 210 and a lateral side portion 208 that extend along the respective sole medial side 110 and the sole lateral side 108. The upper medial side portion 210 extends upwardly from the sole medial side 110 to an upper medial side edge 212. The upper lateral side portion 208 extends upwardly from the sole lateral side 108 to an upper lateral side edge 214. As illustrated in the figures, the upper medial side edge 212 and the upper lateral side edge 214 extend rearwardly from opposite sides of a toe box 204 forming, in combination, an upper edge 263, as seen in FIG. 2 hereinafter. As best seen in FIG. 1, the length of the upper medial side edge 212 and the upper lateral side edge 214 define a forefoot opening 217 in the upper 202 that opens to the shoe interior 103.

The upper 202 is also constructed with the toe box 204 that extends around and across the sole top surface at the sole toe end 104. The toe box 204 is connected between the upper medial side portion 210 and the upper lateral side portion 208 and encloses a portion of the shoe interior 103 adjacent the sole toe end 104. The upper medial side edge 212 and the upper lateral side edge 214 extend rearwardly from the toe box 204.

A plurality of lacing mechanisms 230 are provided on the upper medial side portion 210 and on the upper lateral side portion 208. The lacing mechanisms may be an aperture through which a string or lace is intended to pass. Additional lacing mechanisms are also contemplated such as hooks, loops, integrated fibers/strings, and the like. For example, the lacing mechanism 230 may be a lacing opening that is typically occupied by a portion of a fastener, such as lacing that close the shoe upper over the forefoot opening 217 of the shoe. However, in an exemplary embodiment, the lacing mechanisms 230 are an eyelet or grommet style aperture. The lacing mechanisms 230 are arranged in lines along the upper medial side portion 210 and the upper lateral side portion 208, as is conventional. As illustrated in the figures, the lacing mechanisms 230, in an exemplary embodiment, extend substantially the entire length of the upper medial side edge 212 and the upper lateral side edge 214.

The shoe upper 202 includes a vamp 218 or a throat positioned rearwardly of the toe box 204, and a tongue 220 that extends rearwardly from the vamp 218 through the forefoot opening 217. The tongue 220 extends along the lengths of the upper medial side portion 210 and the upper lateral side portion 208 to a distal end of the tongue near an ankle opening 216. The length and width of the tongue position the tongue side edges beneath the upper medial side portion 210 and the upper lateral side portion 208, and extend the tongue over the forefoot opening 217 of the shoe.

FIG. 2 illustrates the upper 202 in a substantially planar orientation, in accordance with aspects of the present invention. The term "substantially planar" means the upper is not formed into a foot-receiving form having an interior volume into which a foot may be inserted. "Substantially planar" does not imply a lack in thickness or depth variation. To the contrary, a substantially planar upper 202 is contemplated to have a heel dimensional region 274 (to be discussed hereinafter in greater detail) that intentionally forms a varied thickness region from other portions of the upper 202. A typical knit or woven article as it comes off of a manufacturing machine (e.g., loom, knitting machine) may be in a sheet-like form, with the exception of three-dimensional knitting and weaving techniques. While these articles are in a sheet-like state, they may have variations to thickness based on differences in material utilized and/or techniques implemented. Therefore, a substantially planar article may include a sheet-like article having dimensional thickness variations, in an exemplary aspect.

As depicted in FIG. 2, the upper 202 is substantially planar and comprised of a plurality of functionally varied regions. It is contemplated that the upper 202 is formed, as depicted in FIG. 2, as an integrally manufactured article. Stated differently, the upper 202 is formed in a unitary fashion from a common machine that utilizes varying techniques to impart the functional regions and dimensional characteristics. This is in contrast to a typical shoe construction that requires a plurality of subsequent manufacturing processes to couple one or more components to an underlying substrate to achieve varied functional zones. For example, a cut and sew (or bond) approach may be utilized in a typical upper construction where multiple discrete cut pieces are mechanically connected with sewing and/or adhesives in a series of discrete events. Advantages of a unitarily formed substantially planar upper over traditional shoe manufacturing may include reduced labor, reduced time, and greater quality control, in an exemplary aspect.

While the terms "medial" and "lateral" will be used herein for purposes of convenience, it is intended and understood that each term could be substituted for the other term. Or, in the alternative, it is understood that generic terms, such as "first" and "second" could be substituted for either medial or lateral. This substitution is, in part, to allow for a right shoe construction and a left shoe construction. Similarly, it is contemplated that some portions of the upper 202 may alternatively be coupled (either integrally or mechanically) to an opposite side (e.g., the heel portion 206 may be integrally coupled with the medial side portion 210 as opposed to the illustrated lateral side portion 208, in an exemplary aspect).

Starting at the bottom leftmost portion of FIG. 2, the upper 202 is comprised of a lateral heel edge 240. The lateral heel edge 240 is formed to be mechanically coupled with a medial heel edge 241 to form a three-dimensional upper. The lateral heel edge 240 is a portion of the upper 202 perimeter. The perimeter may be constructed having different characteristics than other portions/regions of the upper 202. For example, it is contemplated that the perimeter, which is referenced as a perimeter region 260, may be formed as a multi-layer density weave region. The perimeter region 260 may have a relatively low modulus of elasticity compared to other regions of the upper 202. Additionally, the perimeter region 260 may have multiple layers for reinforcement against ripping, tearing, unraveling, and other potentially destructive characteristics. In an exemplary aspect, the perimeter region 260 may be formed with a high density weaving technique that may incorporate varied materials (e.g., low stretch synthetic fibers). Additionally, it is contemplated that the perimeter may be formed with a multi-layer weaving technique. Because the perimeter region 260 may be a region in which mechanical fastening (e.g., sewing, bonding, tacking, and the like) may be implemented to transform a substantially planar upper to a three dimensional upper, the enhanced resistance to deformation may be implemented.

The lateral heel edge 240 extends downwardly from the top of the perimeter region 260, which is referred to as an ankle edge 261. The lateral heel edge 240 extends down to a medial lower heel edge 255, which is also part of the perimeter region 260, in an exemplary aspect. The medial lower heel edge 255 continues around the heel portion 206 as it becomes a lateral lower heel edge 257. The combination of the medial lower heel edge 255 and the lateral lower heel edge 257 form a lower edge of the heel portion 206.

Continuing on from the lateral lower heel edge 257, the perimeter extends to a lateral heel flap edge 256. The lateral heel flap edge 256 merges into a lateral flap edge 242 in the toewardly direction. The lateral flap edge 242 forms into the lateral toe flap edge 244. In combination the lateral heel flap edge 256, the lateral flap edge 242, and the lateral toe flap edge 244, in part, define a lateral sole flap 252. The lateral sole flap 252, in an exemplary aspect, may be coupled with an opposite medial sole flap 250 along the lateral flap edge 242 to form a bottom portion of the interior 103 of the shoe 100. Stated differently, the lateral sole flap 252 and the medial sole flap 250 may be mechanically coupled to form, in part, a bottom surface of a three dimensional volume, as will be illustrated in FIG. 8 hereinafter.

Similarly, it is contemplated that the lateral heel flap edge 256 may be coupled with the lateral lower heel edge 257 to also form, in part, a three-dimensional volume, the interior 103. Further, it is contemplated that the lateral toe flap edge 244 and a lateral toe edge 245 may be coupled to also form, in part, a three-dimensional volume, the interior 103.

Alignment of a first edge with a second edge may be accomplished, in an exemplary aspect utilizing one or more registers. For example, FIG. 2 depicts a plurality of triangular registers extending from the perimeter portion 260. In a post-processing step in which a first edge is mechanically coupled (e.g., sewn, sealed, bonded, adhered) with a second edge to form a three-dimensional volume, a first register from the first edge may be aligned with a second register from the second edge.

The lateral toe edge 245 extends toewardly from the lateral toe flap edge 244 intersection around the toe box 204 as part of the perimeter region 260. The lateral toe edge 245 merges into a medial toe edge 248. Together, the medial toe edge 248 and the lateral toe edge 245 form a toe edge defining a perimeter of the toe box 204.

Figure 8:
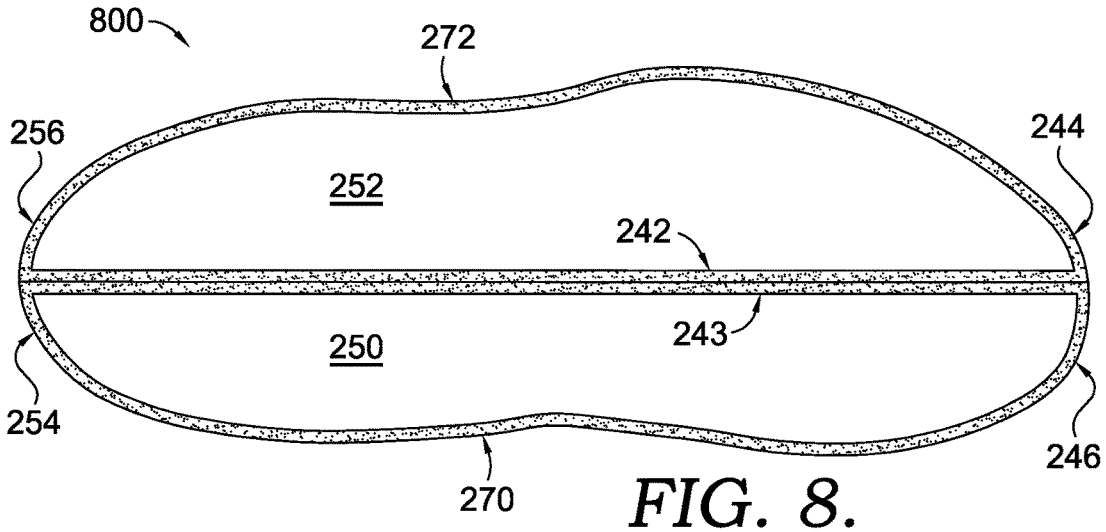
FIG. 8 depicts a bottom-up view of the upper formed in a three-dimensional state from the manufactured substantially planar state, in accordance with aspects of the present invention.

The medial toe edge 248 intersects a medial toe flap edge 246. The medial toe flap edge 246 intersects with the medial flap edge 243, which extends heelwardly to a medial heel flap edge 254. The medial flap edge 243 was previously discussed as a coupling edge in connection with the lateral flap edge 242. The medial heel flap edge 254 merges into the medial heel edge 241, which was previously discussed as being formed in complement to the lateral heel edge 240. Together the medial toe flap edge 246, the medial sole flap 250, and the medial heel flap edge 254 define, at least in part, a perimeter of the medial sole flap 250. The medial toe flap edge 246 and the medial toe edge 248 are contemplated as being coupled, in part, to form the three-dimensional volume of the upper 202. Similarly, it is contemplated that the medial heel flap edge 254 and the medial lower heel edge 255 are contemplated as being coupled, in part, to form the three-dimensional volume of the upper 202. As previously discussed, the medial sole flap 250 and the lateral sole flap 252 may be coupled to form a lower portion (e.g., sole-like surface) of the upper 202 when in a three-dimensional configuration, as illustrated in FIG. 8 hereinafter.

In an exemplary aspect, it is contemplated that the medial sole flap 250 and the lateral sole flap 252 are mechanically coupled with the sole 102 of FIG. 1. For example, it is contemplated that the upper 202 is coupled with the sole 102, at least in part by way of the medial sole flap 250 and the lateral sole flap 252. It is also contemplated that the medial sole flap 250 and the lateral sole flap 252 may be positioned between an insole inserted into the interior 103 of the shoe 100 and the top surface of the outsole 102. Further, yet, it is contemplated that medial sole flap 250 and the lateral sole flap 252 may be positioned between a bottom surface of a midsole portion and a top surface of an outsole portion of the sole 102. It is further contemplated that alternative and/or additional mechanism for coupling the upper 202 to the sole 102 may be implemented.

The medial heel edge 241 extends along the medial side portion 210 to the forefoot opening 217 as defined by the previously discussed medial side edge 212 and the lateral side edge 214. The lateral side edge 214 extends heelwardly to intersect with the ankle edge 261, which, as previously discussed, intersects the lateral heel edge 240.

Together, the perimeter edges discussed define a substantially planar upper 202 that may be manufactured in a sheet-like manner having varied materials (e.g., organic, synthetic), varied manufacturing technique (e.g., differing weaving techniques), varied physical properties (e.g., modulus of elasticity, impact attenuation), and varied geometric properties (e.g., shape, dimension, thickness). It is further contemplated that the upper 202 may be formed in a multiple-unit operation that results in a number of similar or different uppers to be formed during a common manufacturing operation. The uppers, such as upper 220, may then be removed from the multi-unit collection by cutting, trimming, sheering, etching, burning, melting, and other known techniques.

The upper 202 is also comprised of functionally-varied regions. Functionally-varied regions are portions of the upper 202 that have varied physical characteristics from other portions of the upper 202. The varied physical characteristics may include a different modulus of elasticity. As used herein, a modulus of elasticity is a measure of ability to stretch in one or more directions. For example, the upper 202 may be comprised of a "non-stretch" portion, a "standard stretch" portion, and a "stretch" portion. The terms are not intended to be literally interpreted, but instead intended to provide a relative measure of elasticity. Therefore, a stretch portion has a greater modulus of elasticity than a non-stretch portion. This does not imply that a non-stretch portion is without stretch; instead, it means the non-stretch portion is more limited in stretch than a standard or stretch portion of the upper 202.

The upper 202 may have strategically placed functional regions, such as stretch regions. For example, the upper 202 is illustrated in this exemplary aspect as having a medial flap stretch region 270. The medial flap stretch region 270 is located on the medial side of the upper 202 at the convergence of the medial sole flap 250 and the medial side portion 210 approximate an arch location of a foot when received in the interior 103. A corresponding lateral flap stretch region 272 is located on the lateral side of the upper 202 at the convergences of the lateral sole flap 252 and the lateral side portion 208. It is contemplated that the medial flap stretch region 270 and the lateral flap stretch region 272 are functional to adapt the shape of the upper 202 as it is formed into a three dimensional form having a sole, such as the sole 102. The ability to stretch in the strategic position and geometry provided, in an exemplary aspect, increases the ease of manufacturing a three dimensional object from a substantially planar form.

Another functional region contemplated is a toe stretch region 266. The toe stretch region 266 is integrated into a portion of the toe box 204 of the upper 202. The toe stretch region 266 is functional to provide a more comfortable toe box 204 for a wearer. The toe stretch region 266 may also improve the manufacturability of the shoe from the substantially planar form to a three dimensional form by providing adjustability and the ability to compensate when manipulated from a planar to multi-dimensional state. It is also contemplated that a more durable material may be integrated into the toe stretch region 266 to protect the toe box 204 from damage.

The heel portion 206 is comprised of a heel stretch region 268. The heel stretch region 268 is functional to increase manufacturability and wearability of the resulting shoe. For example, the heel stretch region 268 may allow for a more form-fitting upper 202 to a wearer's inserted heel region.

The forefoot region of the upper 202 is comprised of a combination of a forefoot non-stretch region 262 and a forefoot stretch region 264. In combination, the two functional regions provide increased stability, wearability, and utility to the shoe. For example, the forefoot non-stretch region 262 is effective to transfer a lacing load applied by one or more lacing mechanisms. The load may be effectively transferred through the upper 202 downwardly towards a sole or merely around a user's inserted foot. The reduction of stretch in the forefoot non-stretch region 262 relative to surrounding areas allows for a uniform distribution of load and tension to the upper 202 and a connected sole. However, while the forefoot non-stretch region 262 may be effective to distribute lacing mechanism forces, it may also reduce the wearability of the upper 202 by limiting stretch in the toe to heel direction for a user during movements. Therefore, it is contemplated that the forefoot stretch region 264 is placed between portions of the forefoot non-stretch region 262, as illustrated. The forefoot stretch region 264 inserts a degree of flexibility into the upper 202 that increases the wearability and ability to form to a user's inserted foot.

Stated differently, the forefoot non-stretch region 262 is formed in a wave-like pattern extending from a crest-like position at the upper edge 263 downwardly towards a flap or side edge. Each crest of the wave-like form corresponds to a lacing mechanism, such as a second eyelet 234. Between two crests, the forefoot stretch region 264 is located. The forefoot stretch region 264 may allow for a toe-to-heel direction separation between two consecutive crests. Further, as illustrated, it is contemplated that the forefoot non-stretch region 262 follows the toe end of the forefoot opening across to the opposite side of the forefoot opening. This uninterrupted continuation, in an exemplary aspect, provides structural integrity proximate the forefoot opening and further aids in effectively transferring loads asserted by a lacing mechanism. Additionally, it is contemplated that the forefoot non-stretch region 262 extends toewardly proximate the toe box 204 to also provide structural integrity and effective transferring of lacing mechanism loads within the upper 202.

Another functional region contemplated is the heel dimensional region 274, which is located in the heel portion 206 proximate a portion of the ankle edge 261. The heel dimensional region 274 is a region that has a greater thickness from an interior surface to an exterior surface, sometimes referred to as a collar. Such a change in thickness/dimensionality may be accomplished by varying the material utilized in producing the region. The variation may also be accomplished by varying the manufacturing technique utilized in that region (e.g., change from a plain weave to a dual-layer weave, allowing for floating yarns, insertion of filler yarns). Additionally, it is contemplated that a multi-layer weave may be implemented that creates a pocket into which a filler material may be inserted (e.g., injectable foam, injectable yarns). In an exemplary aspect, the injection of a material prevents disturbing the structural integrity of the article by cutting an opening to insert a filler or other material. By injecting the material, the integrity of the woven member may be maintained. The heel dimensional region 274 increases the wearability for a user of the shoe by providing a dissipation of force exerted by the heel portion 206 on the Achilles region of a wearer. Further, the heel dimensional region 274 may provide a better fit for the wearer as it has a greater volume to conform to the contours of an inserted wearer's ankle.

The creation of a functional region may be accomplished in a number of manners. One technique contemplates utilizing different weaving techniques to achieve a variation in functionality. For example, a non-stretch region may be formed utilizing a twill-like weaving technique. A stretch region may be accomplished by utilizing a satin weaving technique. A breathability region may be accomplished by utilizing a leno weaving technique, a hatching weaving, a slit weaving, and/or a plain-loose weaving technique (see e.g., FIG. 15). Additionally, it is contemplated that multiple layers may be incorporated to achieve the functional regions (e.g., additional layers for reinforcement functionality).

Figure 18:
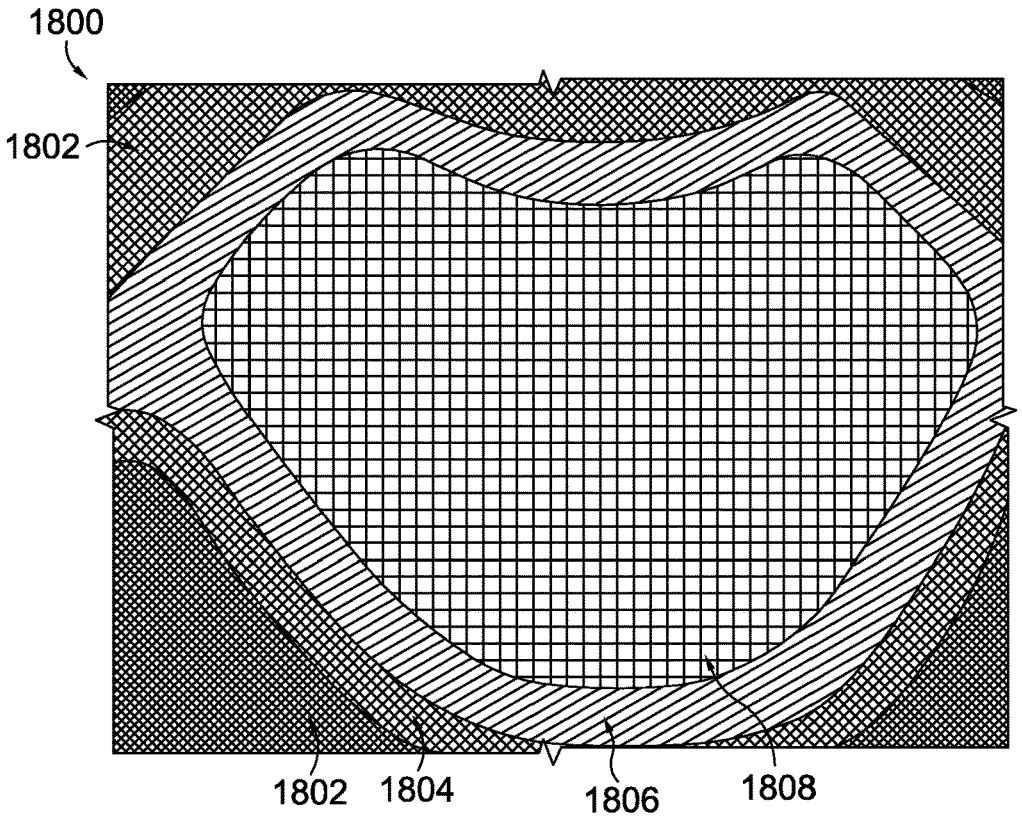
FIG. 18 depicts a multi-region woven portion, in accordance with aspects of the present invention.

It is contemplated that a first functional region may be surrounded by a second functional region, in an exemplary aspect (see. e.g., FIG. 18). For example, it is contemplated that the heel stretch region 268 is surrounded by a transitional zone in which the material transitions from the stretch functionality to the standard functionality, which may be accomplished by altering a manufacturing technique employed at the heel stretch region 268. Similarly, it is contemplated that the toe stretch region 266 may be surrounded, in part, by another transitional region. The utilization of a transitional region in both examples may also be used to provide a reinforcement region to enhance the structural integrity of the upper 202. Similarly, it is contemplated that the heel dimensional region 274 is also surrounded, at least in part, by a transitional region. The transition region may provide a reinforcement border to prevent creep of the dimensional volume with wear and use, in an exemplary aspect.

Another exemplary region of the upper 202 includes a breathability region 275 in the toe box 204 of the upper 202. The breathability region 275 may be formed from an open weave or otherwise looser material configuration to allow for the permeability of air into an interior (or the escape of air to the exterior).

While specific combinations and locations of functional regions are depicted and discussed herein, it is contemplated that any combination of functional regions may be implemented in any location and at any size/shape. Therefore, the examples provided are not limiting, but instead exemplary in nature. Additional functional zones may be implemented in different location and in different combinations utilizing different materials and different manufacturing techniques than those explicitly recited herein.

The ankle edge 261 is also comprised of a first eyelet 232. When the lateral heel edge 240 is coupled with the medial heel edge 241, the first eyelet 232 and the second eyelet 234 serve as the consecutive eyelets in the three-dimensional upper form, as will be illustrated in FIG. 4 hereinafter.

FIG. 2 also depicts a relative modulus of elasticity in both the approximate toe-to-heel direction and in the approximate medial-to-lateral direction. In an exemplary aspect, it is contemplated that there is a greater degree of elasticity in the latter direction than in the former direction. For example, the toe stretch region 266 would have a greater modulus of elasticity in the medial/lateral direction compared to the toe/heel direction, in an exemplary aspect. However, based on the exemplary configuration of the upper 202, because the heel portion is oriented perpendicular to the general toe-to-heel direction, the greater degree of elasticity is in the ankle edge 261 to the lateral lower heel edge 257/medial lower heel edge 255 direction as opposed to the lateral heel edge 240 to the lateral side portion 208 direction. This directional difference in elasticity may be accomplished, in an exemplary aspect, utilizing a weaving technique wherein the warps or the wefts are of a greater degree of elasticity than the other of the warps/wefts, for example. It is contemplated that the degree of relative elasticity may be opposite than that which is depicted in FIG. 2. Further, it is contemplated that the relative elasticity may be similar in two or more directions, in an exemplary aspect.

Figure 3:
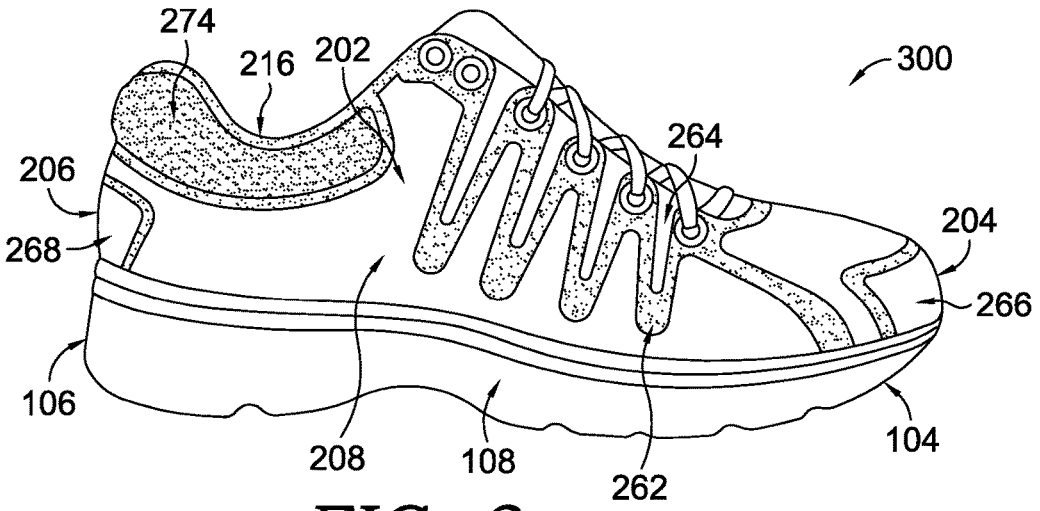
FIG. 3 depicts a lateral-side view of the upper formed in a three-dimensional state from the manufactured substantially planar state, in accordance with aspects of the present invention.

FIG. 3 depicts a lateral side view 300 of the upper 202 formed in a three-dimensional state from the manufactured substantially planar state, in accordance with aspects of the present invention. The lateral side 108, the heel end 106, and the toe end 104 of the sole are depicted. Similarly, the lateral side portion 208, the toe box 204 and the heel portion 206 are depicted having a variety of functional zones. For example, the heel stretch region 268, the heel dimensional region 274, the forefoot non-stretch region 262, the forefoot stretch region 264, and the toe stretch region 266 are depicted. Additionally depicted in FIG. 3, is the ankle opening 216.

Figure 4:
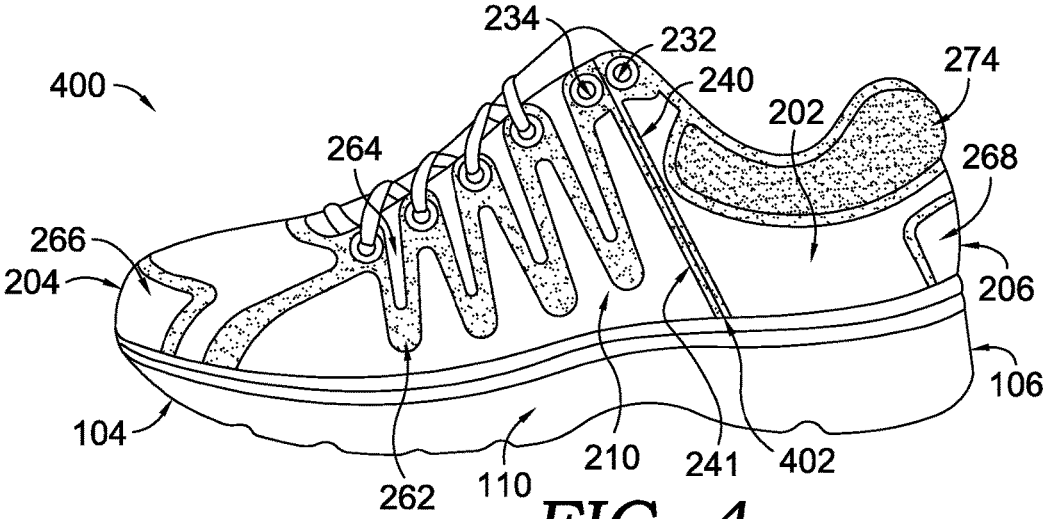
FIG. 4 depicts a medial-side view of the upper formed in a three-dimensional state from the manufactured substantially planar state, in accordance with aspects of the present invention.

FIG. 4 depicts a medial side view 400 of the upper 202 formed in a three-dimensional state from the manufactured substantially planar state, in accordance with aspects of the present invention. The medial side 110, the heel end 106, and the toe end 104 of the sole are depicted. Similarly, the medial side portion 210, the toe box 204 and the heel portion 206 are depicted having a variety of functional zones. For example, the heel stretch region 268, the heel dimensional region 274, the forefoot non-stretch region 262, the forefoot stretch region 264, and the toe stretch region 266 are depicted.

FIG. 4 also depicts the mechanical coupling of the lateral heel edge 240 with the medial heel edge 241 to form an upper seam 402. The upper seam 402 may be formed using any type of joining technique. For example, sewing, adhesives, laminating, mechanical fasteners, and the like are contemplated. For example, it is contemplated that a combination of sewing and adhesives, such as a thermal activated adhesive may be utilized. Further yet, it is contemplated that the upper seam 402 may be at any location and at any orientation. Therefore, it is contemplated that the upper seam 402 may be formed along an Achilles region of the heel portion such that there is a medial heel portion and a lateral heel portion of the substantially planar upper that when joined, form a seem proximate the Achilles region of a wearer. The first eyelet 232 and the second eyelet 234 are also depicted on each side of the upper seam 402 in this exemplary aspect.

Figure 5:
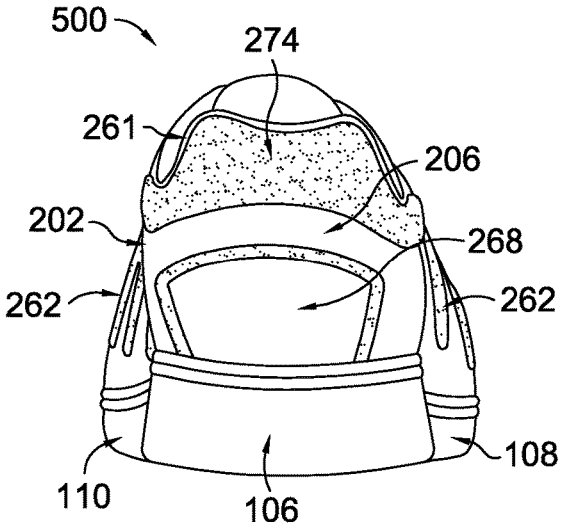
FIG. 5 depicts a heel-end view of the upper formed in a three-dimensional state from the manufactured substantially planar state, in accordance with aspects of the present invention.

FIG. 5 depicts a heel end perspective 500 of the upper 202 formed in a three-dimensional state from the manufactured substantially planar state, in accordance with aspects of the present invention. The heel end 106, the medial side 110, and the lateral side 108 of the sole are depicted. The heel portion 206 is depicted along with functional regions, such as the forefoot non-stretch region 262, the heel dimensional region 274, and the heel stretch region 268. Additional indicated is the ankle edge 261.

Figure 6:
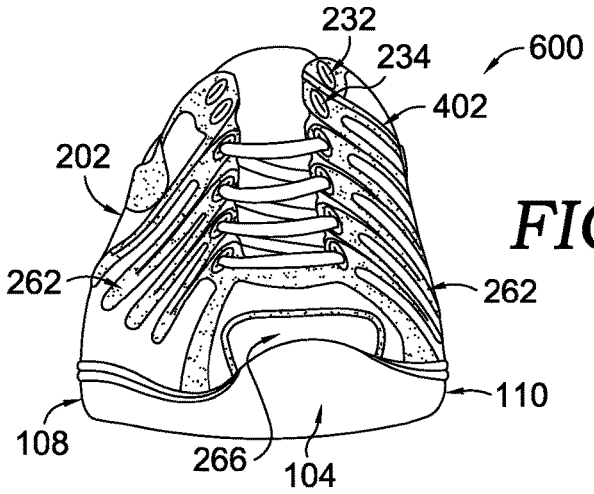
FIG. 6 depicts toe-end view of the upper formed in a three-dimensional state from the manufactured substantially planar state, in accordance with aspects of the present invention.

FIG. 6 depicts a toe end perspective 600 of the upper 202 formed in a three-dimensional state from the manufactured substantially planar state, in accordance with aspects of the present invention. The toe end 104, the medial side 110, and the lateral side 108 of the sole are depicted. Additionally, the functional regions of the toe stretch region 266 and the forefoot non-stretch region 262 are depicted. The first eyelet 232 and the second eyelet 234 on either side of the upper seam 402 are also depicted.

Figure 7:
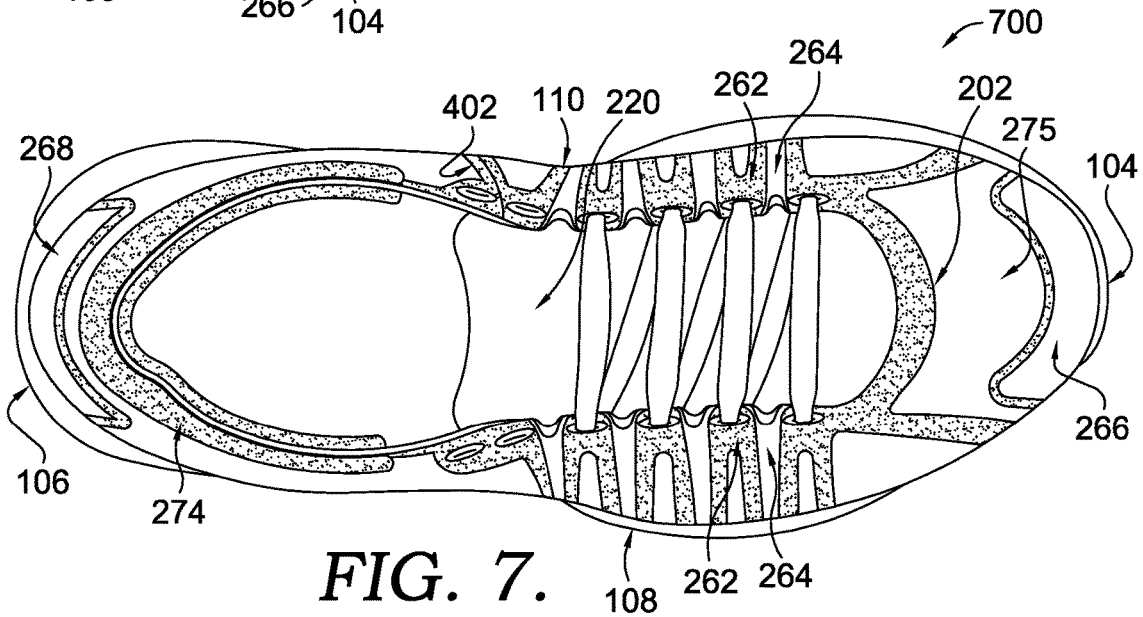
FIG. 7 depicts a top-down view of the upper formed in a three-dimensional state from the manufactured substantially planar state, in accordance with aspects of the present invention.

FIG. 7 depicts a top perspective 700 of the upper 202 formed in a three-dimensional state from the manufactured substantially planar state, in accordance with aspects of the present invention. The toe end 104, the heel end 106, the medial side 110, and the lateral side 108 of the sole are depicted. Additionally, the functional regions of the toe stretch region 266, the breathability region 275, the forefoot non-stretch region 262, the forefoot stretch region 264, the heel stretch region 268, and the heel dimensional region 274 are depicted. Also depicted is the upper seam 402 on the medial side of the upper 202.

FIG. 8 depicts a bottom perspective 800 of the upper 202 formed in a three-dimensional state from the manufactured substantially planar state, in accordance with aspects of the present invention. The depicted perspective is without a sole attached allowing a view of the various edges mechanically coupled to form the three-dimensional form of an upper. In particular, the lateral sole flap 252 and the medial sole flap 250 are depicted such that the lateral flap edge 242 is couple with the medial flap edge 243 are coupled joining the two sole flaps. Similarly, the lateral heel flap edge 256 and the medial heel flap edge 254 are illustrated and while not explicitly depicted, coupled to the lateral lower heel edge 257 and the medial lower heel edge 255 respectively. Further, the lateral toe flap edge 244 and the medial toe flap edge 246 are illustrated and while not explicitly depicted, coupled to the lateral toe edge 245 and the medial toe edge 248 respectively.

As will be discussed hereinafter, it is contemplated that one or more lockout strands or lockout strand assemblies may leverage the mechanical joining of the lateral flap edge 242 and the medial flap edge 243 to secure and anchor one or more portions of a lockout strand. For example, a lockout strand that extends from a forefoot opening (e.g., as part of a securing/lacing mechanism) may be secured within the seam formed between the lateral flap edge 242 and the medial flap edge 243. Further, it is contemplated that one or more portions of a lockout strand may extend through the seam between the lateral flap edge 242 and the medial flap edge 243 such that when the formed upper is secured to a bottom unit (e.g., sole assembly), the one or more portions of the lockout strand are also secured to the bottom unit and/or the upper. For example, if an adhesive or other bonding agent is applied to a surface portion of the upper for securing to a surface of a bottom unit, the adhesive or bonding agent may also interact with the portions of the lockout strand(s) to secure those elements as well. Therefore, it is contemplated that the sewing and or adhering that may be used to form the upper and/or secure the upper to the sole may further aid in anchoring or securing one or more portions of a lockout strand, in exemplary aspects.

While a slip last type of construction is depicted, it is contemplated that any type of lasting construction may be implemented in exemplary aspects. For example it is contemplated that a strobel last (e.g., a material is coupled with the upper along a perimeter portion roughly matching a midsole perimeter) may be utilized in aspects. Further, it is contemplated that a hybrid last may be utilized that incorporates two or more lasting techniques. An example of a hybrid lasting may include utilizing a strobel last in a heel region and a slip last in a metatarsal region of the foot.

Integrated Lockout Strand

It is contemplated that the following features may be implemented in a substantially planar shoe upper. Additionally it is contemplated that the following features may be implemented in a three-dimensional article, such as a formed shoe upper. Therefore, the following is not limited to substantially planar shoe upper implementations.

Figure 9:
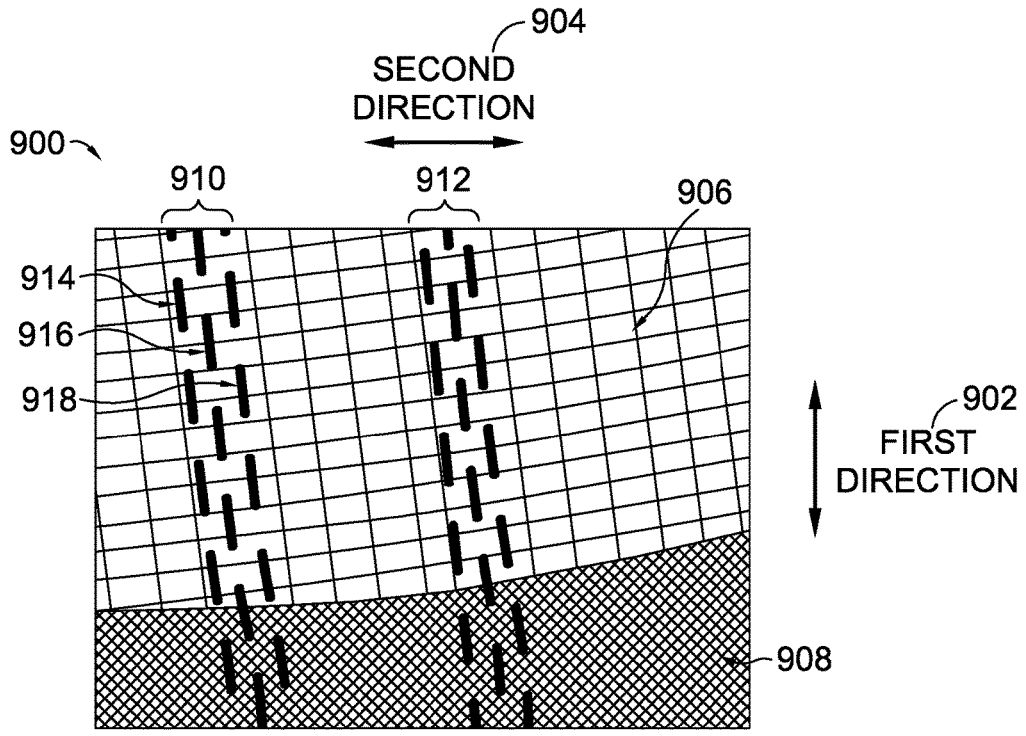
FIG. 9 depicts an exemplary portion of an upper having integrally woven lockout strands, in accordance with aspects of the present invention.

FIG. 9 depicts an exemplary portion of an upper 900 having integrally woven lockout strands, in an exemplary aspect. Lockout strands are a material having a relatively low modulus of elasticity (e.g., substantially no stretch under normal usage scenarios). Examples of lockout strands include, but are not limited to, synthetic materials, organic materials, and multi-component structures. Further, it is contemplated that a lockout strand may be a cable, thread, yarn, filament, cord, or any other structure suitable for providing an integrated and/or inserted flexible member for use as a lockout strand. Specific example of a lockout strand include a nylon, a polyester, a metallic, a carbon fiber, and/or another material cable having a diameter between 0.5 millimeters and 2.0 millimeters. However, smaller and larger diameters are contemplated herein.

It is contemplated that a lockout strand forms, at least in part, a non-stretch functional region in a woven upper. As previously discussed, a non-stretch region may be formed utilizing a variety of weaving techniques and/or materials. In an exemplary aspect, the utilization of a lockout strand reduces the modulus of elasticity of a region of a woven shoe upper in at least one direction (e.g., in a direction parallel with the lockout strand, in a direction in which the lockout strand resists tension).

In an exemplary aspect, the lockout strands are functional to transfer a tension load from a lacing apparatus (e.g., shoe lace) from the forefoot region around the medial and lateral side of a user's foot towards the sole. The lockout strands provide a zone of minimal stretch that is effective for securing a shoe to the user's foot. In an additional exemplary aspect, the utilization of lockout strands are integrated and/or inserted into a woven upper to provide zonal control of a modulus of elasticity. Therefore, it is contemplated that a region of a shoe upper that is desired to have a first attribute (e.g., breathability from a plurality of woven apertures) that may introduce a greater degree of stretch than desired to that region, the lockout strands may also be utilized to achieve the desired modulus of elasticity while still achieving the first attribute (as will be seen in FIG. 12 hereinafter).

Returning to FIG. 9, the upper 900 is woven with wefts and warps generally in the direction of a first direction 902 and a second direction 904. As will be discussed with respect to FIGS. 10 and 11 hereinafter, the lockout strands may extend in the first direction 902, the second direction 904, and/or a direction non-orthogonal to the first direction 902 and the second direction 904. Similar to the lockout strands, it is contemplated that the warps/wefts may be oriented in exemplary aspects in either the first direction 902 or the second direction 904. In an exemplary aspect, the lockout strands are depicted in an orientation substantially parallel with the wefts.

The upper 900 is comprised of a first region 906 and a second region 908, in this exemplary aspect. The first region 906 may be a first functional region and the second region 908 may be a second, different, functional region in an exemplary aspect. For example, it is contemplated that the first region 906 may be a ventilation region allowing for a greater degree of air/moisture movement through the upper 900 that the second region 908, which may be a reinforcement region, for example. As depicted, a first group 910 of lockout strands and a second group 912 of lockout strands extend in from the first region 906 into the second region 908 in a direction substantially parallel to the first direction 902.

The first group 910 is comprised of a first lockout strand 914, a second lockout strand 916, and a third lockout strand 918. While three lockout strands are depicted, it is contemplated that any number may be used in any orientation. The lockout strands 914 and 196 are offset as to which elements in the second direction 904 they are interwoven. This offsetting may be utilized to achieve a stronger integration of the lockout strands with a region of the woven upper 900.

In an exemplary aspect, the first group 910 may extend from a lacing mechanism proximate a forefoot opening (or any location) of the upper 900. For example, it is contemplated that an eyelet is formed into the upper 900 through the creation of an aperture during the weaving process. The first group 910 may be interwoven with the upper 900 proximate (and even potentially around) the aperture. Therefore, the first group 910 is effective to transfer a force applied to the lacing mechanism (e.g., eyelet) by a lacing structure downwardly towards a sole (e.g., a midsole portion). In tan exemplary aspect, the second region 908 may be an integrally woven reinforcement zone that terminates, securely, within the second region 908 by way of the weaving technique implemented in the second region 908, in this example.

Figure 10:
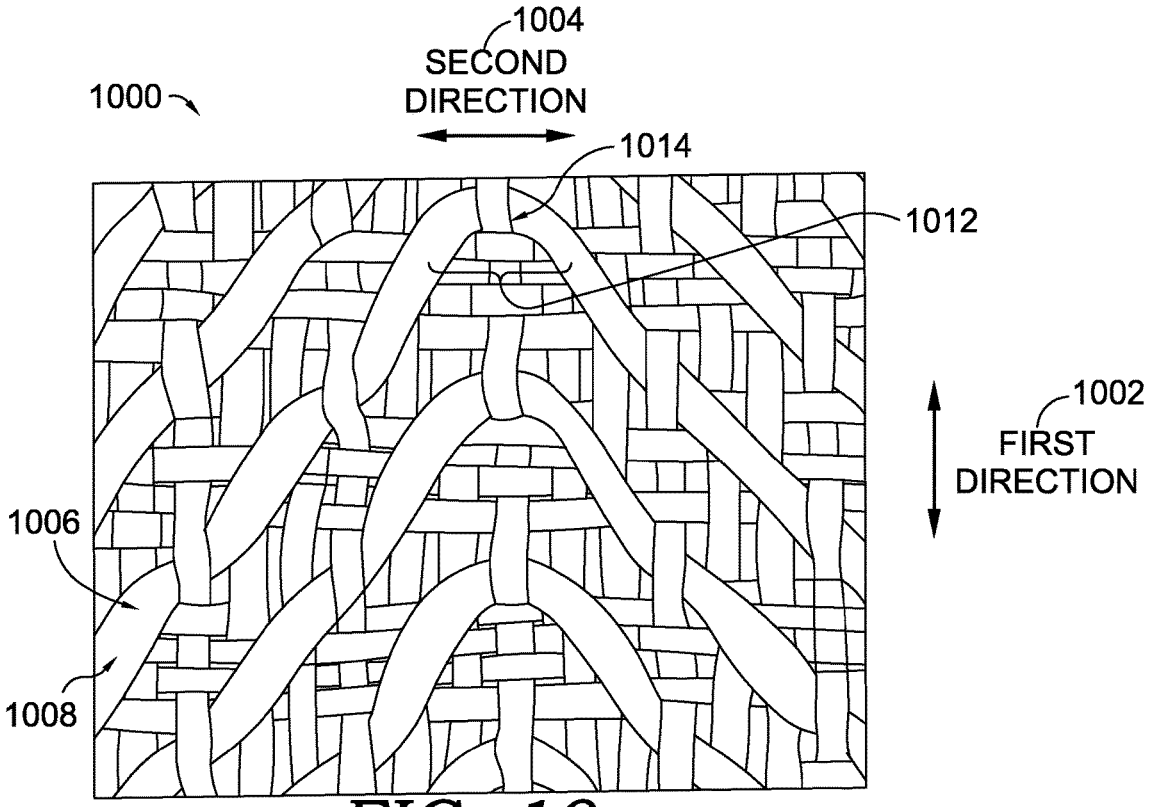
FIG. 10 depicts an exemplary woven portion comprised of warps and wefts with non-orthogonally oriented lockout strands, in accordance with aspects of the present invention.

FIG. 10 depicts an exemplary woven portion 1000 comprised of warps and wefts with non-orthogonally oriented lockout strands, in accordance with aspects of the present invention. An exemplary non-orthogonally oriented lockout strand 1006 is integrated with members in a substantially first direction 1002 while floating over members oriented in a second direction 1004. The members in the first direction 1002 are the warps, in an exemplary aspect.

The lockout strand 1006 has a first portion 1008 and a second portion 1010 with an apex 1014. At the apex 1014, an exemplary angle 1012 is formed. It is understood that the angle 1012 may be any angle. In the depicted aspect, the angle 1012 may be a right angle, which results in a substantially 45 degree traverse of the first direction 1002 and the second direction 1004, in this example. However, it is contemplated that any angle of traverse of any members is contemplated to achieve non-orthogonally oriented lockout strand integration.

The apex 1014 represent a point in which the lockout strand 1006 changes from a first primary direction to a second primary direction. While the apex 1014 is depicted as occurring on the underlying warp/weft substrate, it is also contemplated that the apex 1014 may be beyond the substrate (e.g., past an edge). The apex extending past an edge may provide a lacing mechanism portion, such as a loop through which a lacing structure may be inserted.

Figure 11:
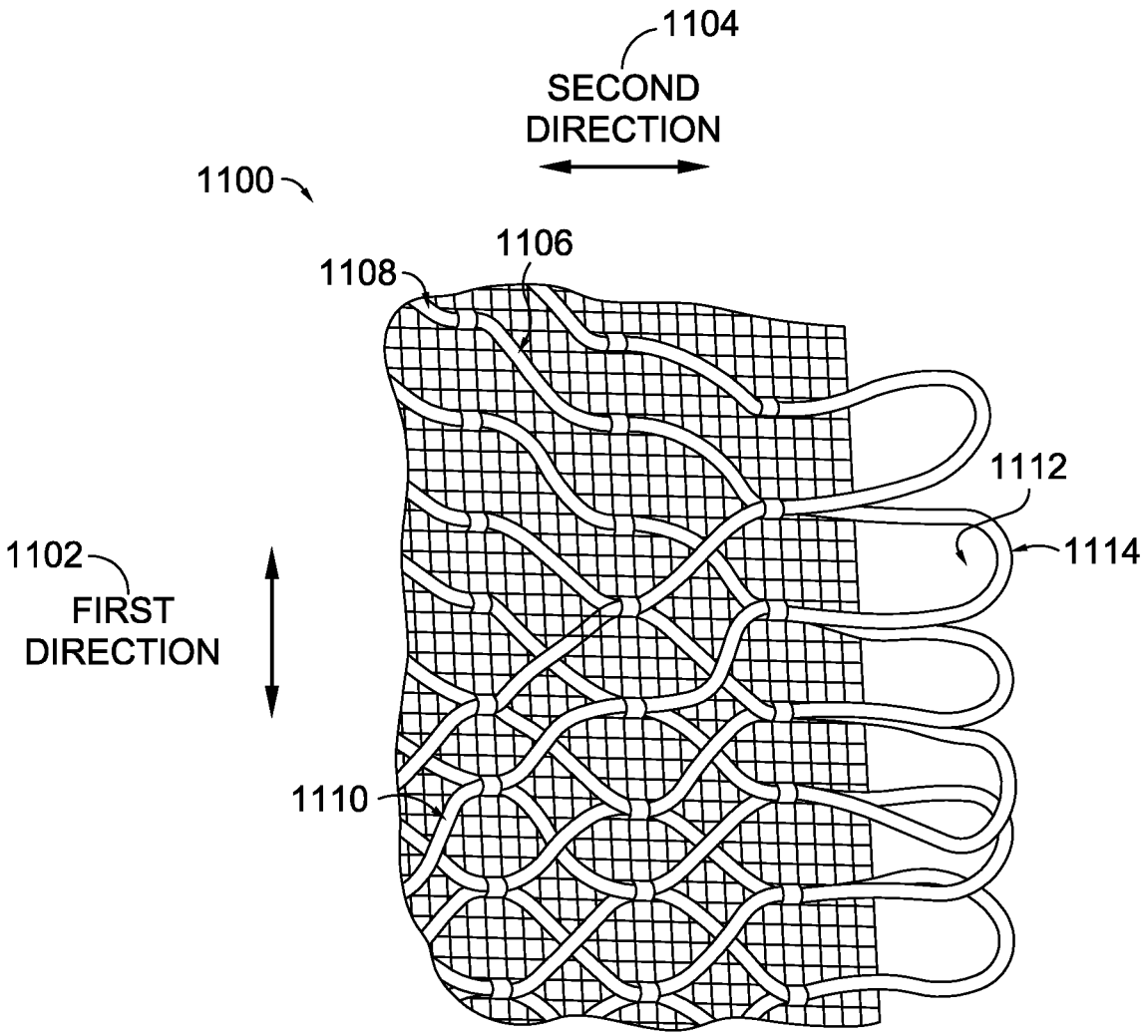
FIG. 11 depicts another exemplary woven portion comprised of warps and wefts with non-orthogonally oriented lockout strands, in accordance with aspects of the present invention.

FIG. 11 depicts an exemplary woven portion 1100 comprised of warps and wefts with non-orthogonally oriented lockout strands, in accordance with aspects of the present invention. An exemplary non-orthogonally oriented lockout strand 1106 is integrated with members in a substantially first direction 1102 while floating over members oriented in a second direction 1104. The members in the first direction 1102 are the wefts, in an exemplary aspect.

The lockout strand 1106 has a first portion 1108 and a second portion 1110 with an apex 1114. At the apex 1114, an exemplary loop 1112 is formed. As with FIG. 10, it is contemplated that the lockout strand 1106 may traverse at any angle relative of any members is to achieve non-orthogonally oriented lockout strand integration.

The loop 1112 may be utilized as part of a lacing mechanism, as previous discussed. Additionally, it is contemplated that the loop 1112 may be coupled with one or more portions of a shoe. For example, upon lasting an upper having the loop 112, the loop 112 may be sewn (or otherwise coupled) with the last. For example, the loop 1112 may be integrated into a strobel stitch or a slip last stitch to securely anchor the lockout strand to a portion of the resulting shoe, such as the midsole. While the apex 1114 is depicted as extending beyond a warp/weft substrate, it is contemplated that the apex 1114 may occur within the warp/weft substrate at any location.

As depicted, it is contemplated that a lockout strand mat be interwoven with the warps and/or wefts of an underlying substrate. For example, during the weaving process utilizing traditional warps and wefts, the lockout strand may be integrated during the movement of heddles, prior to packing the shed, and/or following the packing of the shed, but prior to removing the woven article from the loop. It is contemplated that a jacquard-type loom may be utilized to form the substrate and an attachment may be positioned proximate the shed of the substrate coming off the loom that is responsible for interweaving the lockout strand. Additionally, it is contemplated that a traditionally weft may be replaced or augmented with a lockout strand during the weaving process to achieve an interwoven lockout strand. Further, it is contemplated that a warp may be replaced or augmented with a lockout strand to also achieve an integrally formed interwoven lockout strand in the warp direction.

Lockout Assembly

It is contemplated that the following features may be implemented in a substantially planar shoe upper. Additionally it is contemplated that the following features may be implemented in a three-dimensional article, such as a formed shoe upper. Therefore, the following is not limited to substantially planar shoe upper implementations.

Figure 12:
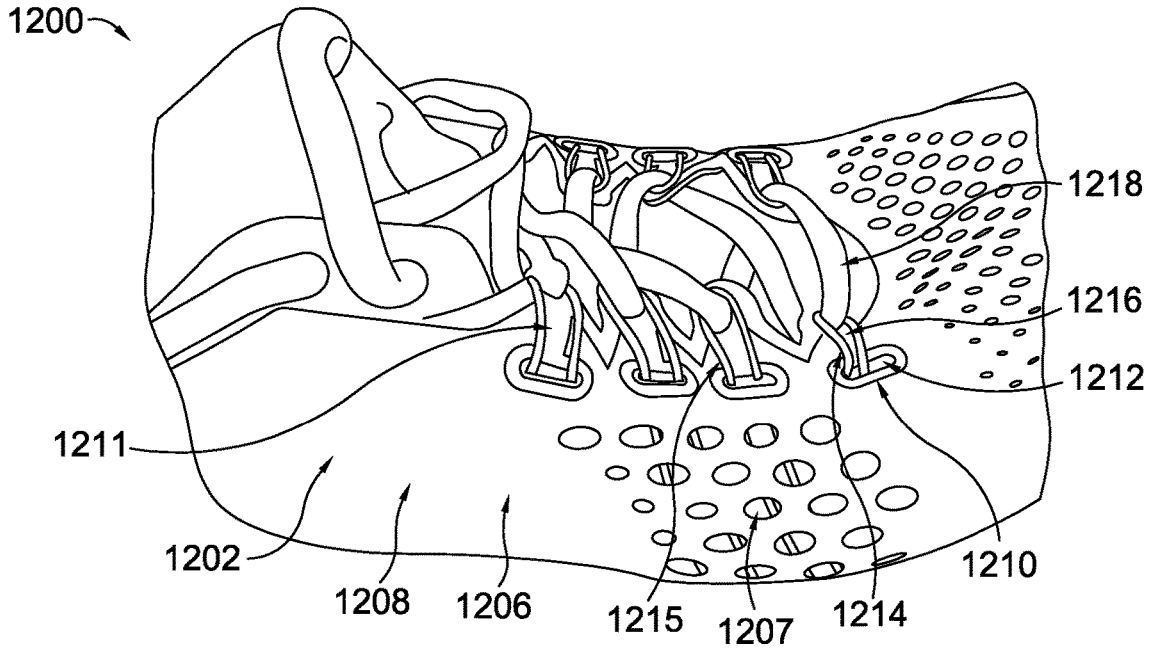
FIG. 12 depicts a portion of an exemplary shoe having a lockout assembly, in accordance with aspects of the present invention.

FIG. 12 depicts a portion of an exemplary shoe 1200, in accordance with aspects of the present invention. The shoe 1200 is comprised of an upper 1202 that forms a cavity between an exterior layer 1206 and an interior layer 1207 utilizing a multi-layer weaving technique. The cavity provides a volume of space in which a lockout strand may be inserted to serve as a functional member of the upper 1202.

For example, it is contemplated that a lockout strand 1214 may pass through the cavity along the lateral side portion 1208. The lockout strand may then go through the exterior layer 1206 at an aperture 1212. The aperture, as previously discussed, may be formed with aperture reinforcement 1210, such as a non-stretch region integrally formed with the exterior layer 1206. The lockout strand may form a loop 1216 that is serves as a lacing mechanism through which a lace 1218 (or any other lacing structure) may pass.

Within the cavity between the exterior layer 1206 and the interior layer 1207, the lockout strand may extend downwardly towards a sole of the shoe 1200. It is contemplated that the cavity may have a perimeter where the multiple layers are integrally formed as a single layer, such as with a jacquard loom. At the cavity perimeter, the lockout strand 1214 may be coupled with the upper, such as with a lasting stitch (e.g., strobel stitch). Additionally, it is contemplated that the lockout strand may pass through another aperture to be coupled with one or more other portions of the shoe 1200.

As depicted in FIG. 12, a plurality of the lockout strands pass through the internal cavity of the lateral side portion 1208. While each lockout strand is depicted as exiting the cavity through a unique aperture, it is contemplated that one or more lockout strands may share a common aperture. Further, it is contemplate that a lockout strand may exit the cavity through a first aperture and may loop back to re-enter the cavity at a second aperture, in an exemplary aspect. Further, it is contemplated that the lockout strand is incorporated into a lacing mechanism, such as an eyelet within the upper 1202 proximate a forefoot opening.

Also depicted in FIG. 12 is a zonal reinforcement 1211. The zonal reinforcement 1211 is positioned along the forefoot opening and is also integrated into the aperture reinforcement 1210, in an exemplary aspect. The zonal reinforcement 1211 may be an integrally woven zone or an applied zone (e.g., laminate). The zonal reinforcement 1211 may provide a non-stretch or reinforcement function aiding in the securing of the foot to a user's foot.

Figure 13:
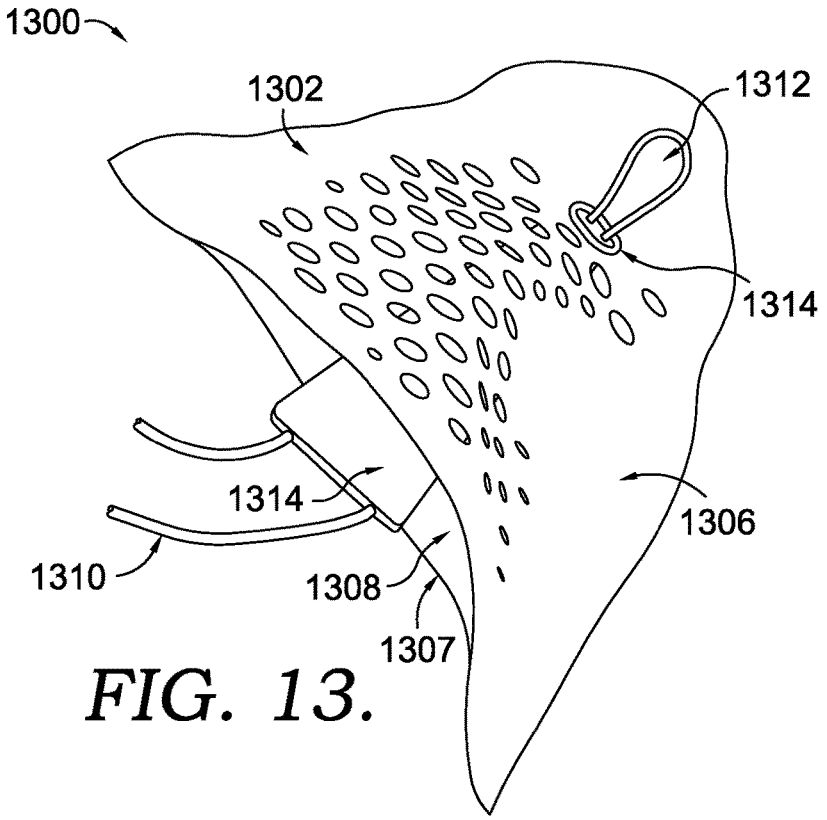
FIG. 13 depicts a cut-away, multi-layer, woven portion of an upper, in accordance with aspects of the present invention.

FIG. 13 depicts a cut-away, multi-layer, woven portion 1300 of an upper 1302, in accordance with aspects of the present invention. As previously discussed, it is contemplated that an internal cavity may be formed during a common weaving process using a weaving technique, such as that performed by a jacquard loom. The multi-layer woven article can take a single layer and diverge into two or more layers during the weaving process. Consequently, if a cavity is desired, an interior layer 1307 and an exterior layer 1306 may be formed to define an internal cavity 1308.

As previously discussed, the internal cavity formed in a woven shoe upper may provide a volume through which a lockout strand may be inserted. For example, a lockout strand 1310 is depicted as passing through the cavity 1308 and out of the cavity, through the exterior layer 1306, at an aperture 1316. In this depicted example, the lockout strand forms a loop 1312 after exiting the cavity 1308. As contemplated herein, the loop 1312 may be utilized as a lacing mechanism.

In an exemplary aspect, it is contemplated that the cavity 1308 forms a functional zone, such as a filled pocket. The cavity 1308 may be filled with floating yarns, padding, fibers, injectable foam, foam, and other fillers 1314 (e.g., spacer mesh—a knit or woven dimensional material having a first surface and a second parallel surface spaced apart and maintained by elements extending between said surfaces) and impact attenuators.

In an exemplary aspect, the fillers 1314 may be inserted to separate the interior layer 1307 from the exterior layer 1306 to facilitate the insertion or incorporation of the lockout strand 1310, in an exemplary aspect. For example, it is contemplated that a spacer mesh material (or any filler material) may be inserted into a cavity formed between two layers of a woven article. The spacer mesh, in this example, may provide several functional advantages.

First, it is contemplated that when weaving a multi-layer portion of a woven article, a number of threads (or fibers) forming each surface is reduced by the number of layers being formed. For example, in a two-layer pocket as contemplated herein, the number of warps may be half that of a single layer construction. Therefore, it is contemplated that the spacer mesh material may provide structural support and/or structural integrity to compensate for the reduced density of woven fibers caused by the formation of multiple layers. Further, it is contemplated that the lockout strands may be inserted into the pocket/cavity after formation of the substantially planar woven upper.

The insertion may be aided by the dimensional characteristics of a spacer mesh that ensures the interior layer 1307 and the exterior layer 1306 are maintained separate to provide a convenient path for insertion of the lockout strand without unintentionally breaching either of the layers. Further to this point, the spacer mesh material (or any filler) may allow for a dispersion of forces applied by the lockout strand as experienced by a wearer's foot when in an as-worn configuration. For example, to limit the sensation of tension along the side of a foot, the filler material may aid in dispersing the energy across a greater portion of the wearer's foot, in an exemplary aspect.

In a further aspect, the use of spacer mesh or any filler material may allow for the absence of specifically engineered channels through which the lockout strands may extend. For example, a more general pocket may be formed that is not sized and positioned specifically for a lockout strand, but instead, the pocket may be formed for receiving the filler material that may be used for multiple lockout strands that extend there through in varied and shoe-specific path. Stated differently, the implementation of a filler or spacer mesh adds adaptability to the manufacturing process as specific channels or features do not need to be formed for individual lockout strands. Instead, a general pocket may be formed having greater tolerances that is adapted to receive the filler/spacer mesh. The received spacer mesh/filler may not be formed having a specific channel through which the lockout strand extends, but instead the lockout strand may pass through any portion of a volume of the filler/spacer mesh.

Manufacturing Techniques

It is contemplated that any type and combination of manufacturing techniques may be implemented in exemplary aspects. For example, it is contemplated that a substantially planar upper may be formed in a loom that is functional to alter the materials and weaving techniques utilized in one or more regions. Similarly, it is contemplated that a knitting machine may be implemented to form a substantially planar upper, as provided herein.

Traditionally, weaving utilizes two distinct directional sets of yarns/threads/fibers/filaments that are interlaced orthogonally to one another to form the resulting cloth or fabric. For example, a first directional set running in a first direction of the resulting fabric may be referred to as a warp set, or "warps" for short. Interlaced at a right angle to the warps are a second directional set, referred to as a weft set, or "wefts" for short. Stated differently, longitudinal elements (e.g., threads, yarn, fibers, and filaments) of a woven article are the warp and the lateral elements are the weft.

Depending on a number of factors, characteristics of the resulting fabric may be affected. Those characteristics may include, but are not limited to, the fabric's size, shape, feel, look, texture, impact absorption/attenuation/response, moisture repellency/wicking, thermal energy insulation/dissipation, and the like. Factors that are contemplated as affecting the characteristics include, but are not limited to how the warp and weft are interwoven. Additionally, depending on the size of the elements utilized in the warp and/or the weft relative to other warp and/or weft affect the resulting fabric characteristics. The type of material from which individual (or sets) of elements are formed (e.g., twisted fibers, synthetic filaments, multi-material filaments, and the like) also may affect the characteristics. Reactions and other in-line and post-processing activities (e.g., introduction of stimulus to a reactive material or portion of material) may affect the resulting characteristics of the fabric. Other variables that are manipulated during the weaving process may also affect the resulting characteristics (e.g., tension, loom type, loom characteristics, temperature, and the like). Other variables are considered. Exemplary techniques and mechanisms for manufacturing one or more articles utilizing one or more techniques are also contemplated and described in co-pending, commonly assigned, U.S. Provisional No. 61,590,177, filed Jan. 24, 2012, entitled "Intermittent Weaving Splicer," U.S. Provisional No. 61/590,179, filed Jan. 24, 2012, entitled "Weaving Finishing Device," U.S. Provisional No. 61/590,183, filed Jan. 24, 2012, entitled "Multi-Functional Weaving System," and U.S. application Ser. No. 13/599,531, filed Aug. 30, 2012, entitled "Woven Textile Bag," which claims priority to U.S. Publication No. 61/529,049, filed Aug. 30, 2011, entitled "Woven Textile Apparel And Accessories," all of which are incorporated by reference in their entirety herein.

The formation of a woven product, such as a shoe upper, may occur on a loom-like device. In an exemplary aspect, the loom holds the warp threads in place as weft threads are interlaced in a repeating or non-repeating manner. It is also contemplated that other devices may be implemented other than a traditional loom to form a woven article. For example, tablet weaving, back-strapping, and other techniques are contemplated.

As will be discussed and described in more detail hereinafter, it is possible to implement any number of weaving techniques. In a plain weave (see e.g., FIG. 15) the warp and weft are aligned so they form a simple criss-cross pattern, which may be balanced so that there are the same number of ends per inch (i.e., warps) and picks per inch (i.e., wefts). Another example weaving pattern that is contemplated herein is a twill weave (see e.g., FIG. 15). In a twill weave, a pattern of diagonal parallel ribs (also referred to as a wale) may be visible. The ribs are formed by passing the weft over one or more warps and then under two or more warps. The following row of wefts then are offset by one or more warps from the previous row providing a stepping pattern. Additionally, a satin weave is contemplated (e.g., See FIG. 15). A satin weave may have four or more wefts floating over a single warp or vice versa. The type of woven process employed is not limited to plain, twill, or satin, but instead they are merely exemplary in nature and may form a building block from which the ultimate weaving process is selected. As will be discussed with respect to FIG. 15 hereinafter, it is contemplated that a modulus of elasticity (e.g., stretchability) may fall on a spectrum from stretchy to non-stretchy. In an exemplary aspect, that spectrum of stretchy to non-stretchy may include the satin weave on a stretchier end from a twill weave on a less stretchy end. The plain weave may be placed on the spectrum of modulus of elasticity between a satin and a twill weave.

In addition to traditional weaving techniques, it is also contemplated that a dobby, jacquard, or other mechanism may be implemented for manipulating heddles or harness (es) controlling the position of one or more warps to form the resulting woven article. Therefore, any combination of weaving techniques may be implemented.

In the alternative of weaving, it is also contemplated that a substantially planar upper may be formed utilizing a knitting technique. A knit article, such as a shoe upper, is an article formed, in an exemplary aspect, through a method of integrating consecutive rows of loops (e.g., stitches) with a subsequent row of loops. A new loop in a subsequent row is pulled through an existing loop of a previous row, in an example. In knitting a yarn/fiber/thread/filament follows a course forming the symmetric loops (i.e., bights) symmetrically above and below the mean path of the yarn. A variety of stitches (e.g., knit or purl, slip-stitch fair-isle, drop-stitch) may be implemented to provide various functionality (e.g., elasticity), dimensional effects (e.g., ribbing, welting, basket weaving) and aesthetic results. Any combination of materials and stitching techniques may be implemented in one or more aspects of the present invention.

A single spun yarn may be knitted as is, or it may be braided or plied with another yarn. In plying, two or more yarns are spun together. When spun together, a direction of spinning may be opposite from which the yarns were originally spun (if at all); for example, two Z-twist yarns may be plied with an S-twist. The opposing twist may relieve some of the yarns' tendency to curl up and produces a thicker, balanced yarn. Plied yarns may themselves be plied together, producing cabled yarns or multi-stranded yarns. Sometimes, the yarns being plied are fed at different rates, so that one yarn loops around the other, as in bouclé.

Exemplary Aspects—Substantially Planar

The following exemplary aspects make reference to features previously discussed with respect to FIG. 2 hereinabove. While specific features are identified from FIG. 2, they are not limiting but instead provided for convenience. Stated differently, it is intended for the additional aspects that are enabled herein, but that are not specifically identified below, are also contemplated within the scope of the present invention. Therefore, the exemplary part numbering provided hereinafter is not intended to limit the scope of the present invention. For example, FIG. 14 demonstrates a similar, but different, exemplary substantially planar upper, in accordance with aspects of the present invention.

An exemplary aspect is a woven substantially planar shoe upper that is comprised of a woven first side portion (e.g., medial side portion 210, lateral side portion 208) extending from a first coupling edge (e.g., medial heel edge 241, lateral heel edge 240) at a heel end towards a toe end and also extending from an upper edge (e.g., upper edge 263) towards a first side edge (e.g., medial flap edge 243, lateral flap edge 242), the upper edge defining, in part, a forefoot opening (e.g., forefoot opening 217) and an ankle opening (e.g., ankle opening 216) into an interior (e.g., interior 103) of the shoe upper portion when the shoe upper portion is formed as a non-planar shoe upper.

The upper is also comprised of a woven second side portion (e.g., medial side portion 210, lateral side portion 208) extending from the heel end towards the toe end and also extending from the upper edge towards a second side edge (e.g., medial flap edge 243, lateral flap edge 242), the second side portion and the first side portion form, in part, a medial side and a lateral side of the shoe upper portion when the shoe upper portion is formed as a non-planar shoe upper.

The upper is further comprised of a woven toe region extending between the first side portion at the toe end and the second side portion at the toe end, the toe region also extending towards the upper edge forming a toe end of the forefoot opening. The upper is also comprised of a woven heel region extending from an ankle edge (e.g., ankle edge 261) to a heel sole edge (e.g., medial lower heel edge 255, lateral lower heel edge 257) and also extending between the heel end of the second side portion and a second coupling edge (e.g., lateral heel edge 240, medial heel edge 241). The first side portion is seamlessly (e.g., woven during a common weaving operation, knit during a common knitting operation) coupled with the toe region. The toe region is also seamlessly coupled with the second side portion. Further, the second side portion is seamlessly coupled with the heel region. The first side portion, the second side portion, the toe portion, and the heel portion are substantially planar. For example, it is contemplated that all portions provided in this exemplary upper were formed during a common weaving operation that also may have incorporated various functional regions.

In an additional exemplary aspect, it is contemplated that a woven shoe upper is comprised of a woven heel portion having an ankle edge and an opposite heel sole edge. The heel portion is comprised of a dimensional portion, a stretch portion, and a non-stretch portion, in this exemplary aspect. The dimensional portion has a thickness greater than the stretch portion and the non-stretch portion. The dimensional portion, the stretch portion, and the non-stretch portion are integrally formed, such as in a common weaving operation.

The upper is further comprised of a woven toe portion having a forefoot edge and an opposite toe sole edge (e.g., medial toe edge 248, lateral toe edge 245). The toe portion comprised of a stretch portion (e.g., toe stretch region 266) and a non-stretch portion (e.g., a transitional region, perimeter region 260). The stretch portion and the non-stretch portion integrally formed, such as during a common manufacturing technique (e.g., a weaving operation).

The upper is also comprised of a woven medial side portion extending between the heel portion and the toe portion on a medial side of the shoe upper, the medial side portion having a first upper edge (e.g., medial side edge 212) and an opposite medial sole edge (e.g., medial flap edge 243, medial toe edge 248). The upper is comprised of a woven lateral side portion extending between the heel portion and the toe portion on a lateral side of the shoe upper, the lateral side portion having a first upper edge and an opposite lateral sole edge (e.g., lateral flap edge 242, lateral toe edge 245).

Another exemplary aspect of the present invention is a shoe construction comprised of a sole and an upper. The upper is comprised of a medial side portion and a lateral side portion. The medial side portion is comprised of a) a first region extending from a forefoot opening towards the sole; b) a second region extending from the forefoot opening toward the first region, the second region having a greater modulus of elasticity than the first region; and c) a first aperture extending through the medial side portion proximate the forefoot opening within the first region. The lateral side portion is comprised of a) a third region extending from a forefoot opening towards the sole; b) a fourth region extending from the forefoot opening toward the third region, the fourth region having a greater modulus of elasticity than the third region; and c) a second aperture extending through the lateral side portion proximate the forefoot opening within the third region. The first region and the second region are integrally coupled sharing a common warp. For example when two regions are formed during a common weaving operation, they share a common warp. This is in contrast to two previously cut portions that are then coupled (e.g., sewn or adhered), which do not share a common weaving warp thread. The third region and the fourth region are integrally coupled sharing a common warp. In an exemplary aspect, it is contemplated that the first, second, third, and fourth regions are formed as part of a substantially planar shoe upper during a single weaving operation.

Exemplary Aspects—Integrally Woven Lockout Strands

The following exemplary aspects make reference to features previously discussed with respect to FIGS. 9-11 hereinabove. While specific features are identified from FIGS. 9-11, they are not limiting but instead provided for convenience. Stated differently, it is intended for the additional aspects that are enabled herein, but that are not specifically identified below, are also contemplated within the scope of the present invention. Therefore, the exemplary part numbering provided hereinafter is not intended to limit the scope of the present invention.

In an exemplary aspect, it is contemplated that a shoe is constructed with a woven upper (or at least a portion of an upper that is woven). The formation of the woven upper may incorporate wefts having a first amount of stretch (i.e., a modulus of elasticity). Similarly the warps may also have a degree of stretch, such as a second modulus of elasticity. The warps and wefts in this example are contemplated has having an amount of stretch that is conducive to forming a function shoe upper that is comfortable to don and wear. However, to achieve desired performance results, a lower modulus of elasticity may be utilized in strategic region, such as a non-stretch region extending from a forefoot opening to a sole coupling portion (i.e., a portion of the upper to which a sole portion is coupled). The non-stretch region may be achieved by interweaving lockout strands with the warps and/or wefts of the upper. In this example, the non-stretch region is achieved by incorporating a lockout strand having a modulus of elasticity that is less than the proximate warp(s) and/or weft(s).

With respect to the orientation of the lockout strands relative to the underlying warps and/or wefts, it is contemplated that the lockout strands may be orthogonally oriented to the warps or wefts, they may be non-orthogonally oriented to the warps/wefts, and/or they may change from a first orientation to a second orientation as they traverse the warps/wefts.

In another exemplary aspect, it is contemplated that a woven shoe upper may be formed with a lateral side portion and a medial side portion. Each of the side portions form, at least in part, a forefoot opening through which a user may insert a foot. The forefoot opening may be defined, at least in part, by a forefoot edge. As is typical with an athletic-type shoe, it is contemplated that a plurality of lacing mechanisms, such as eyelets, are positioned proximate the forefoot edge of both the lateral and the medial side portions. However, in this example, a lockout strand extends downwardly from the forefoot edge of the medial side towards the lower portion of the medial side proximate the midsole. Similarly, a second lockout strand extends downwardly from the forefoot edge of the lateral side towards the lower portion of the lateral side proximate the midsole. In both lockout strands, they are interwoven with the upper proximate the lacing mechanism to effectively transfer a load applied to the lacing mechanism through the upper towards the midsole. Therefore, the woven upper may be formed to achieve a desired aesthetic or functional purpose and the lockout strands may accomplish the desired functional trait of transferring the applied load around a user's foot.

As previously discussed, the interweaving of the lockout strand may include incorporating the lockout strand between a warp and a weft such that the lockout strand is in a common plane as the warp/weft combination. This is in contrast to sewing a secondary material into a woven article, in that example, the secondary material in not integrally woven, but instead alternatives from a first side to a second side of a woven article as it is inserted, this side changing may cause deformations in the woven structure as a load is applied along the length of the secondary material.

Another exemplary aspect contemplates a shoe construction having a sole and an upper. The upper is again comprised of a medial side portion and a lateral side portion. The medial side portion (and an exemplary lateral side portion) is comprised of a first region. The first region, in this example, extends from a forefoot opening toward the sole, such as a sole coupling region of the medial side portion. The first region incorporates a lockout strand, which is a material different from the other warps and wefts within that region of the medial side portion. The interweaving of the lockout strand provides this first region with a modulus of elasticity in the direction of the lockout strand that is less than a second region of the medial side portion.

The second region, in this example, extends from the forefoot opening also towards the sole. However, the second region does not have an interwoven lockout strand. Therefore, the second region has a great modulus of elasticity when measured in the direction of the lockout strands of the first region than the first region.

It is contemplated that the first region may coincide with an eyelet and the second region may coincide with a region between two eyelets along the forefoot opening. Therefore, the first region is functional to transfer a load applied to the eyelet downwardly through the upper while the second region is functional to provide stretch and comfort to a user. The first region and the second region, in this example, are integrally formed from a common weaving operation and therefore share at least a common warp and/or weft.

Exemplary Aspects—Multi-Layered Upper With a Lockout Strand Assembly

The following exemplary aspects make reference to features previously discussed with respect to FIGS. 12-13 hereinabove. While specific features are identified from FIGS. 12-19, they are not limiting but instead provided for convenience. Stated differently, it is intended for the additional aspects that are enabled herein, but that are not specifically identified below, are also contemplated within the scope of the present invention. Therefore, the exemplary part numbering provided hereinafter is not intended to limit the scope of the present invention.

In an exemplary aspect, a shoe construction is comprised of a sole and a woven upper. The woven upper is comprised of a multi-layer portion having a first layer and a second layer. The two layers form a cavity, such as a pocket, a tunnel, or other volume of space between the layers. The upper is also comprised of a reinforcement portion that forms an aperture through the first layer. The reinforcement portion may be an integrally formed portion or it may be a post-weaving portion. For example, it is contemplated that a heat activated laminate (or any laminate) may be affixed to the upper to form the reinforcement portion. Additionally, it is contemplated that a mechanical reinforcement, such as a metallic eyelet may also be added as a reinforcement portion, in an exemplary aspect.

The upper may also be comprised of a lockout strand. The lockout strand extending through the internal cavity of the multi-layer portion of the upper. The lockout strand may then extend out of the cavity through the reinforced aperture of the first layer. For example, it is contemplated that a looped portion of the lockout strand may pass through the internal cavity and extend out of the cavity through an aperture formed proximate a forefoot opening. The looped portion may then serve as a lacing mechanism in an exemplary aspect. The remainder of the lockout strand may continue down the upper towards the sole as an effective mechanism for transferring an applied load toward a midsole of the sole, in this example.

In an exemplary aspect, it is contemplated that a plurality of apertures are formed in the first layer (e.g., the exterior layer or the interior layer). The apertures may be formed during the weaving process to provide a functional zone. As previously discussed, the functional zones may be a stretch zone caused by the apertures or a ventilation zone caused by the apertures.

Another exemplary aspect is directed to a shoe construction comprised of a woven shoe upper having both a medial side portion and a lateral side portion. The medial side portion is comprised of an integrally woven multi-layer portion forming a medial side internal cavity. The integrally woven aspect may be achieved using a jacquard loom that is capable of forming at least two sheds from a common grouping of warps. Additional loom configurations (e.g., a dobby loom) may also be implemented to achieve an integrally woven multi-layer article.

In this example, it is contemplated that a number of apertures extend through an exterior later of the medial multi-layer portion near the forefoot opening. Additionally, it is contemplated that another of other apertures extend through an exterior layer of the lateral multi-layer portion. These apertures may serve as an aperture through which a lockout strand may exit from an internal volume of the upper to an exterior location of the upper, such as near the forefoot opening. Unlike a typical eyelet that passes through the upper to allow threading of a lace, the apertures discussed in this example do not pass through all layers of an upper. Instead, the apertures, in this example, merely provide a means of egress and ingress to the cavity in the multi-layer woven upper.

As with other exemplary multi-layer woven article provided herein, it is contemplated that both a first layer and a second layer of a multi-layer woven article diverge from a common woven layer. For example, two or more layers may share a common weft, such as along a single layer portion. Similarly, it is contemplated that two or more layers may share a common warp, such as along a common layer portion. Therefore, unlike when two independently created articles are coupled in a post-processing fashion (e.g., sewing, bonding), an integrally formed multi-layer woven article is formed from a common weaving operation.

Additional Aspects

Figure 14:
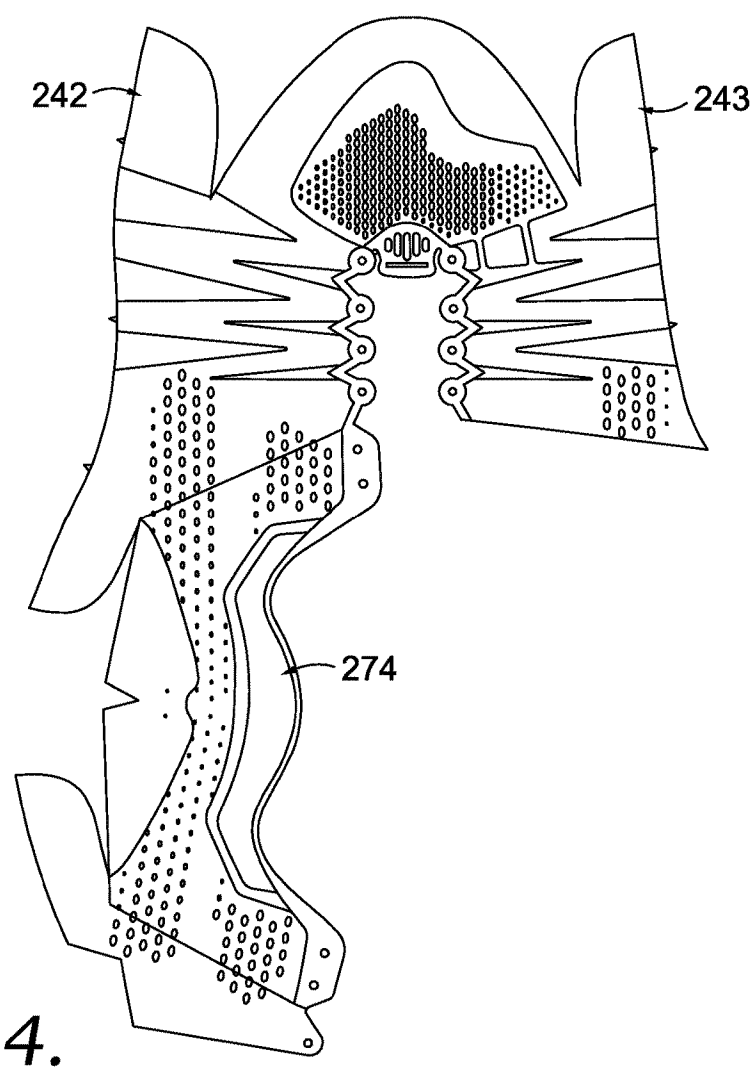
FIG. 14 depicts an additional aspect of a substantially planar woven shoe upper in both a front and a related back perspective, in accordance with aspects of the present invention.
Figure 14:
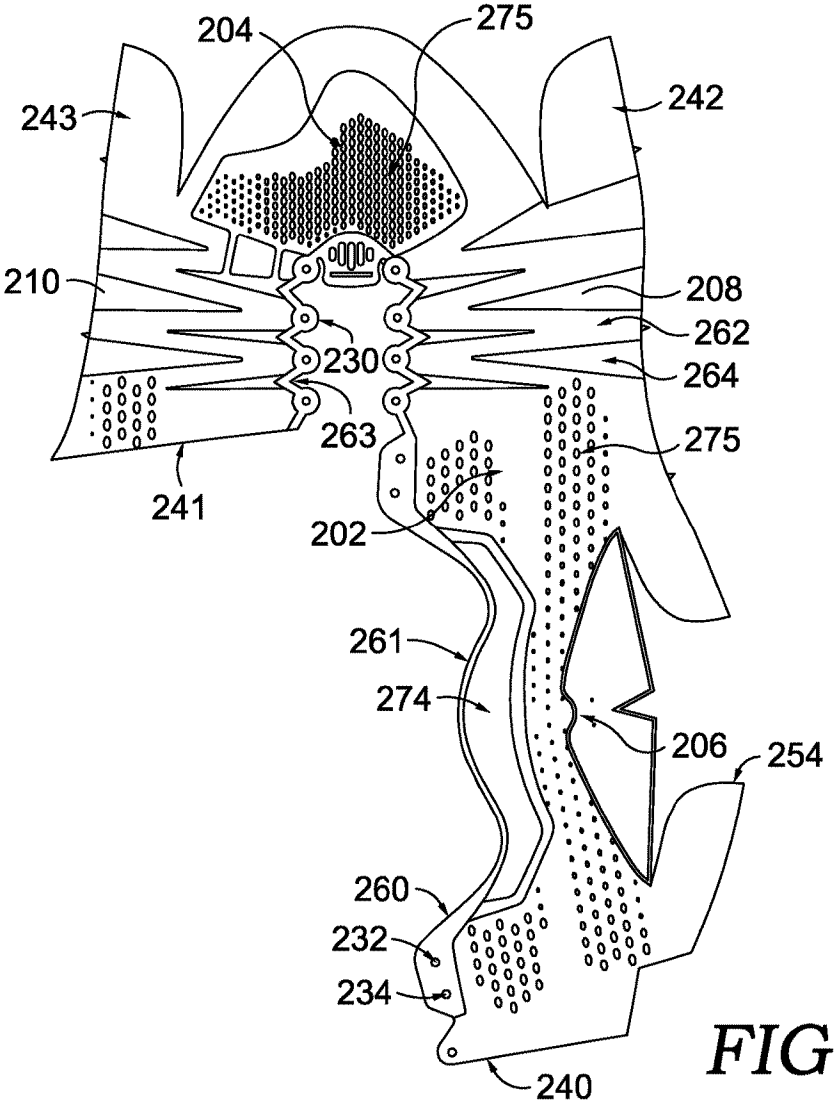

FIG. 14 depicts an additional aspect of a substantially planar woven shoe upper in both a front and a related back perspective, in accordance with aspects of the present invention. Various functional regions are depicted, such as stretch, non-stretch, dimensional, breathability, and the like. Additionally depicted is a region in which a heel counter may be inserted. In an exemplary aspect, it is contemplated that a multi-layer weaving technique may be implemented to form a pocket or cavity into which a heel counter may be inserted. In an exemplary aspect, an enclosed cavity is formed during a weaving operation; however, upon cutting the heel portion from a larger woven article (e.g., beam width portion), the enclosed cavity becomes accessible for the insertion of a supplemental material, such as a structural heel counter piece. A pocket for receiving the heel counter piece is depicted in FIG. 14 proximate the heel portion 206.

While aspects of FIG. 14 a similar to that of FIG. 2 discussed previously, the lateral heel edge 240, when coupled with the medial heel edge 241, is located more toewardly in FIG. 14 than in FIG. 2. Stated differently, the exemplary substantially planar woven upper depicted in FIG. 14 has a more forwardly positioned coupling seem than that of FIG. 2. An additional difference between FIG. 2 and FIG. 14 uppers is the location and position of the medial flap. In FIG. 14, a portion of the medial flap is formed heelwardly from the lateral heel edge 240. As a result, a first portion of the medial flap is located toewardly of the medial heel edge 241 and a second portion of the medial flap is located heelwardly of the lateral heel edge 240. Further, FIG. 14 contemplated a multi-layer weave that creates a first layer forming a back surface and a second layer forming the front surface. The multi-layer aspects may be utilized to provide a varied functional zones by the varied layers. For example, the back layer (i.e., closest to the skin) may be woven to form a comfort layer, such as a terry cloth-type weave. Similarly, the exterior layer may be formed to provide a functional characteristic, such as breathability through a leno weave type technique. As previously discussed, it is contemplated that a variety of weaving techniques may be implemented at various location of the article and at different layers. Stated differently, it is contemplated that a first layer at a first location may be formed with a first weaving technique and a second layer at the first location is formed with a second weaving technique, in an exemplary aspect.

While the number of FIG. 14 is provided, it is provided to identify comparable portions to that which was discussed in FIG. 2 hereinabove. Therefore, it is contemplated that additional features and alternative features are found in FIG. 14 than explicitly described with respect to FIG. 2.

Figure 15:
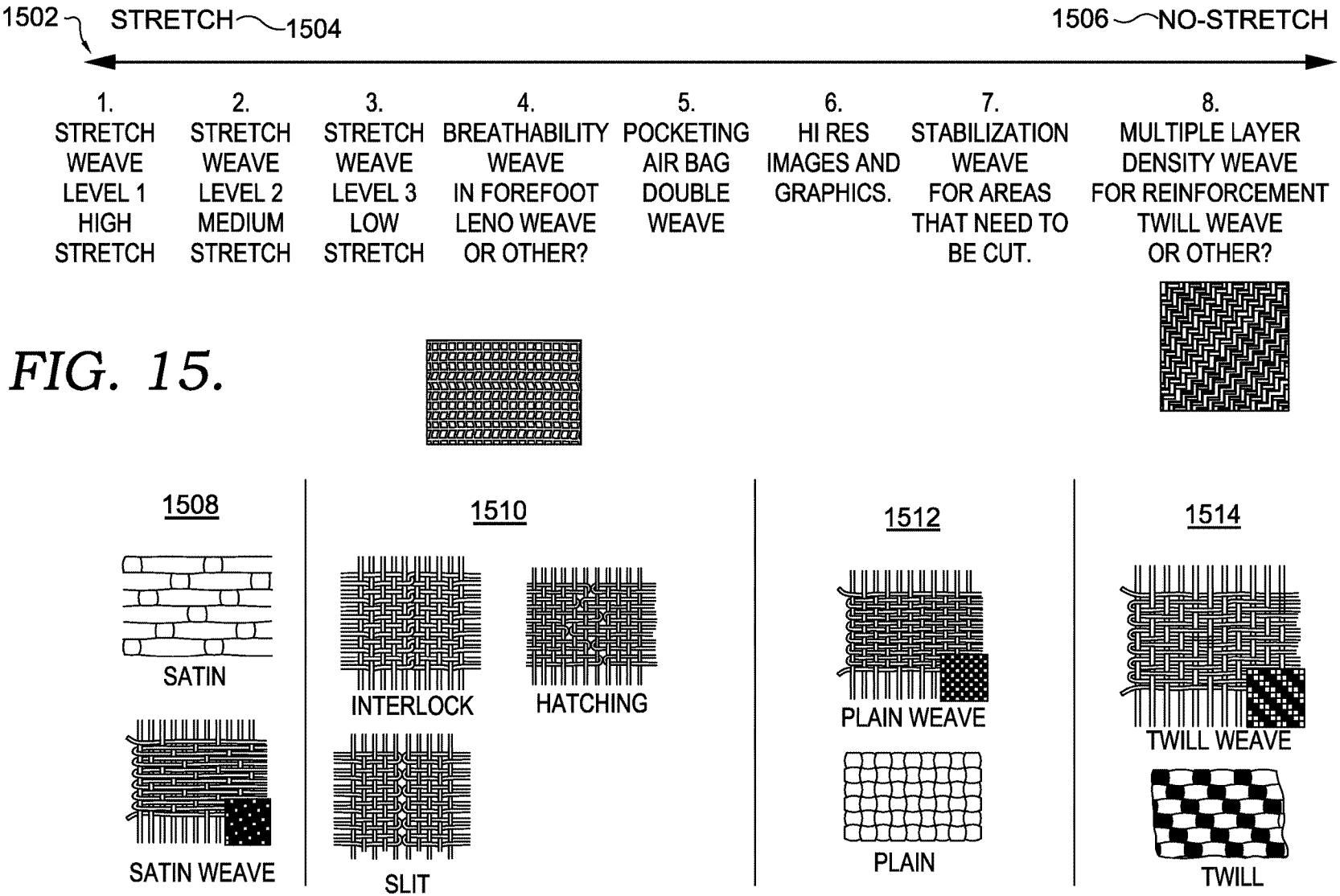
FIG. 15 depicts a spectrum of weaving techniques to achieve a varied modulus of elasticity, in accordance with aspects of the present invention.

FIG. 15 depicts a spectrum of weaving techniques to achieve a varied modulus of elasticity, in accordance with aspects of the present invention. The spectrum of stretch is laid out along a continuum 1502 that extend between a stretch end 1504 and a non-stretch end 1506. A functional zone may utilize one or more weaving techniques associated with a varied degree of elasticity based on the continuum 1502. For example, near the end 1504 when a stretch functional zone is desired, a satin weave technique may be implemented. Exemplary satin weave techniques are illustrated in region 1508 of the continuum 1502. Similarly, when desiring a medium level of elasticity, weaving techniques (e.g., interlock, hatching, slit, and leno) may be implemented, as illustrated in a region 1510. Further, at a lower degree of modulus of elasticity a plain weave may be implemented, as illustrated in a region 1512. Finally, nearest the end 150 demonstrating a non-stretch region of the continuum 1502, a twill weave may be implemented, as depicted at region 1514. Therefore, a resultant amount of stretch may be determined based on the continuum 1502, in an exemplary aspect.

Figure 16:
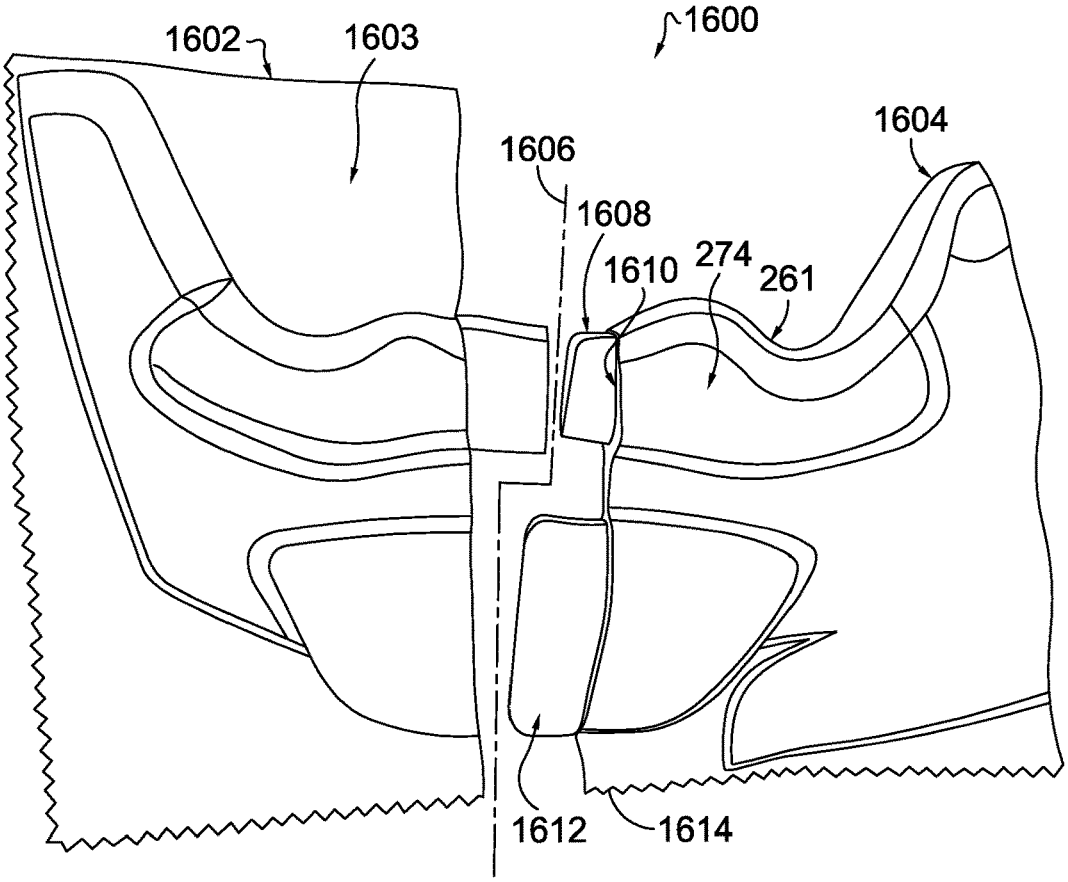
FIG. 16 depicts and exemplary heel region having a dimensional zone and a heel counter zone within a woven upper portion, in accordance with exemplary aspects of the present invention.

FIG. 16 depicts and exemplary heel region 1600 having a dimensional zone and a heel counter zone within a woven upper portion, in accordance with exemplary aspects of the present invention. In particular, the heel region 1600 is cut in half forming an un-finished portion 1602 and a finished portion 1604 that are separated by a cutline 1606, The un-finished portion 1602 include a portion 1603 that is to be removed to form the shoe upper. The portion 1603 has been removed and a finished edge is formed on the finished portion 1604, as will be discussed in greater detail hereinafter at FIG. 17.

The dimensional zone is constructed having a pocket 1610 in to which dimensional material is inserted. The dimensional material may be a foam material 1608 that is injected. Similarly depicted is a heel counter pocket 1614 into which a heel counter material 1612, such as a polymer-based material, is inserted. As previously discussed and will be discussed in more detail with respect to FIG. 18, multiple weaving techniques may be implemented for the various zones, in an exemplary aspect.

Figure 17:
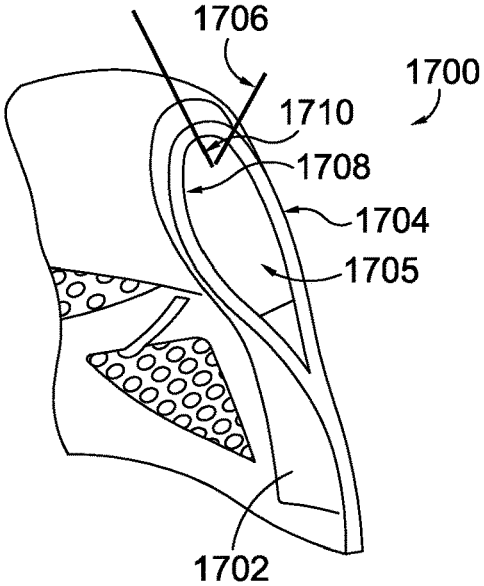
FIG. 17 depicts a cut profile of an ankle collar region, in accordance with aspects of the present invention.

FIG. 17 depicts a cut profile of an ankle collar region 1700, in accordance with aspects of the present invention. The ankle collar may be formed from a multi-layer woven structure into which a dimensional material 1705 is inserted. The multi-layer material may be formed from a first layer 1702 and a second layer 1704. The apex (e.g., top portion) of the ankle collar may be defined at a position 1710. In an exemplary aspect, an upper is formed from a larger portion of material such that a portion of the larger material is removed by cutting, melting, or other techniques. As a result of the removal of excess material, an edge may be formed. In an effort to provide a well fitting and good feeling article of footwear, the edge that is formed may not be desired to be proximate a skin-contacting region of the shoe. Therefore, in an exemplary aspect, the edge is positioned away from a user's potential contact regions. However, in a multi-layer woven article, when the article is cut, the edge will typically be formed at the apex 1710, which may be in a skin-contacting region. Therefore, it is contemplated that a variation in modulus of elasticity between an outer layer 1704 and an interior layer 1708 may be utilized to shift the edge from the apex 1710 to a position 1706 that is more towards an exterior of the ankle collar than the apex 1710. This shift in location may be accomplished by utilizing a weaving technique (or material selection) at the interior layer 1708 that has a greater modulus of elasticity than the outer layer 1704. Consequently, when tension is applied across the interior layer 1708 and the outer layer 1704, the interior layer 1708 stretches a greater degree than the outer layer 1704. Therefore, the edge formed when the ankle collar is cut from the greater portion of material is positioned at 1706 rather than the apex 1710. The insertion of a dimensional material may further exaggerate the movement of the edge away from the apex 1710 as a greater load is applied across the outer layer 1704 and the interior layer 1708.

In an exemplary aspect, it is contemplated that a portion of a woven article is treated with a material in a location prior to cutting at the location to provide a finished edge or an edge that is more easily finished. For example, it is contemplated that a silicone or a urethane (or any material that may bond) is applied to the woven article along a portion that is intended to be an edge (e.g., where a cut may be made). After curing, the applied material may be effective for substantially maintaining the wefts and warps in a desired relative location to one another. Stated differently, it is contemplated that prior to cutting a portion of a woven article from the woven article, that a material is applied proximate the cut location. The applied material helps to keep the edge from fraying (unraveling). However, as discussed above, this applied material may form an edge that is not desirable to be in contact with a wearer's skin. Therefore, as discussed above, manipulating the location at which the edge ultimately is positioned (e.g., outwardly from the apex location) using a variable modulus of elasticity weave between the top layer and the bottom layer may be desired, in an exemplary aspect.

FIG. 18 depicts a multi-region woven portion 1800, in accordance with aspects of the present invention. In a common weaving operation performed by a jacquard-enabled loom, four unique regions are formed. For example, a first region 1802, a second region 1804, a third region 1806, and a fourth region 1808 are formed. In an exemplary aspect, the woven portion 1800 may be a toe box region of a substantially planar woven shoe upper. The first region 1802 may be formed as a reinforcement functional zone that is resistant to abrasion, such as the leading edge of a toe region. It is contemplated that the first region 1802 may be formed with a twill weaving technique that implements a durable filament/fiber. Consequently, it is contemplated that the first region 1802 has a relatively low modulus of elasticity.

The second region 1802 may also be formed with a twill weaving technique. However, it is contemplated that a variation in the weaving may be formed between the first region 1802 and the second region 1804. For example, an alternative twill weaving technique may be utilized and/or alternative materials may be utilized between the regions to accomplish varied functional characteristics. The third region 1806 may utilize a satin weaving technique to provide a greater degree of elasticity than found in the first region 1802 or the second region 1804. The third region 1806 is effective to absorb tension forces exerted across the woven article to allow a breathability region (e.g., region 1808) to continue to provide an effective transfer of air and moisture through the woven article. The fourth region 1808 may be formed utilizing an open-plain weaving technique that is effective to form a breathability region within the woven article.

As depicted in FIG. 18, a variety of weaving techniques in a variety of region formations may be implemented in exemplary aspects of the present invention. As such, FIG. 18 depicts a variety of weaving techniques formed in a common/integrated weaving process that are effective to achieve functional zones/regions within a woven article of footwear.

Figure 19:
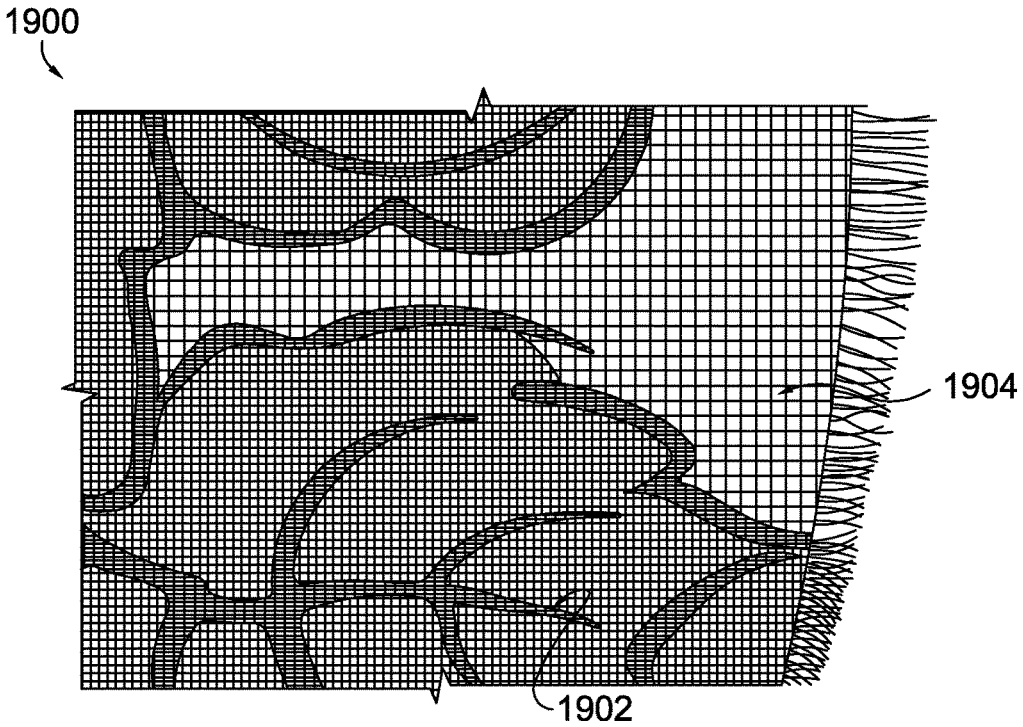
FIG. 19 depicts an exemplary woven article that utilizes a jacquard mechanism in combination with a leno weaving technique, in accordance with aspects of the present invention.

FIG. 19 depicts an exemplary woven article 1900 that utilizes a jacquard mechanism in combination with a leno weaving technique, in accordance with aspects of the present invention. As a result, functional characteristics may be formed in a region, such as reinforcement and/or dimensional portions 1902 based on a jacquard mechanism while also implementing breathability regions 1904 based on a leno weaving technique during a common weaving operation.

Figure 20:
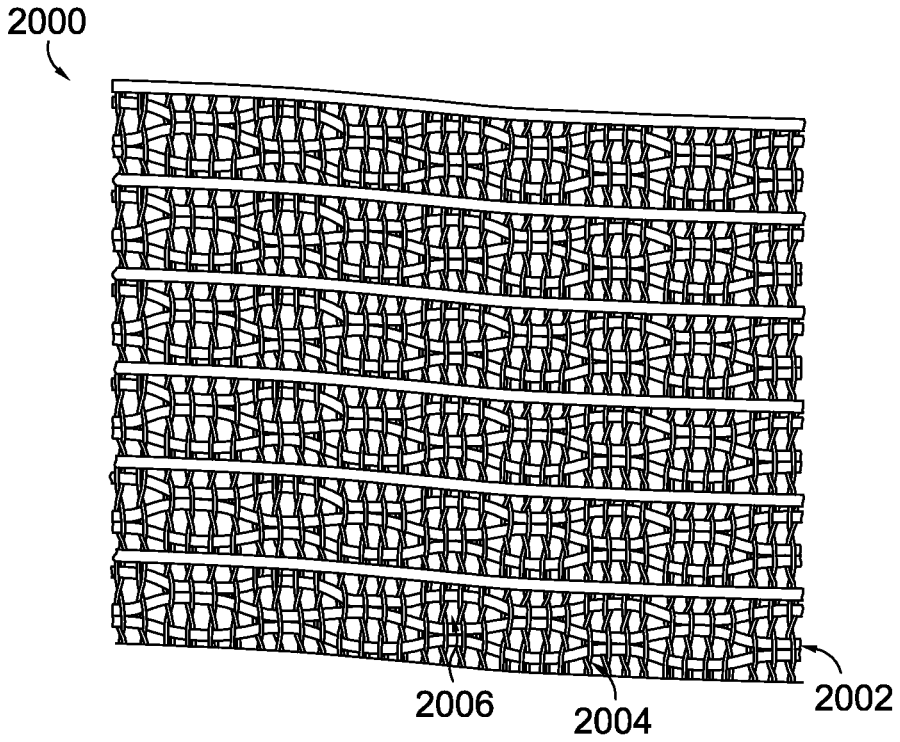
FIG. 20 depicts an exemplary woven article having leno twisted wefts running in the vertical direction and pulled warps running in the horizontal direction, in accordance with aspects of the present invention.

FIG. 20 depicts an exemplary woven article 2000 having leno twisted wefts 2004 running in the vertical direction and pulled (spaced in a wave-like formation) warps 2002 running in the horizontal direction, in accordance with aspects of the present invention. The combination of a leno twisting technique on the wefts 2004 in combination with the physical manipulation of the warps 2002 result in the creation of openings 2006. The opening 2006 may provide a breathability functional zone within a woven shoe portion.

Figure 21:
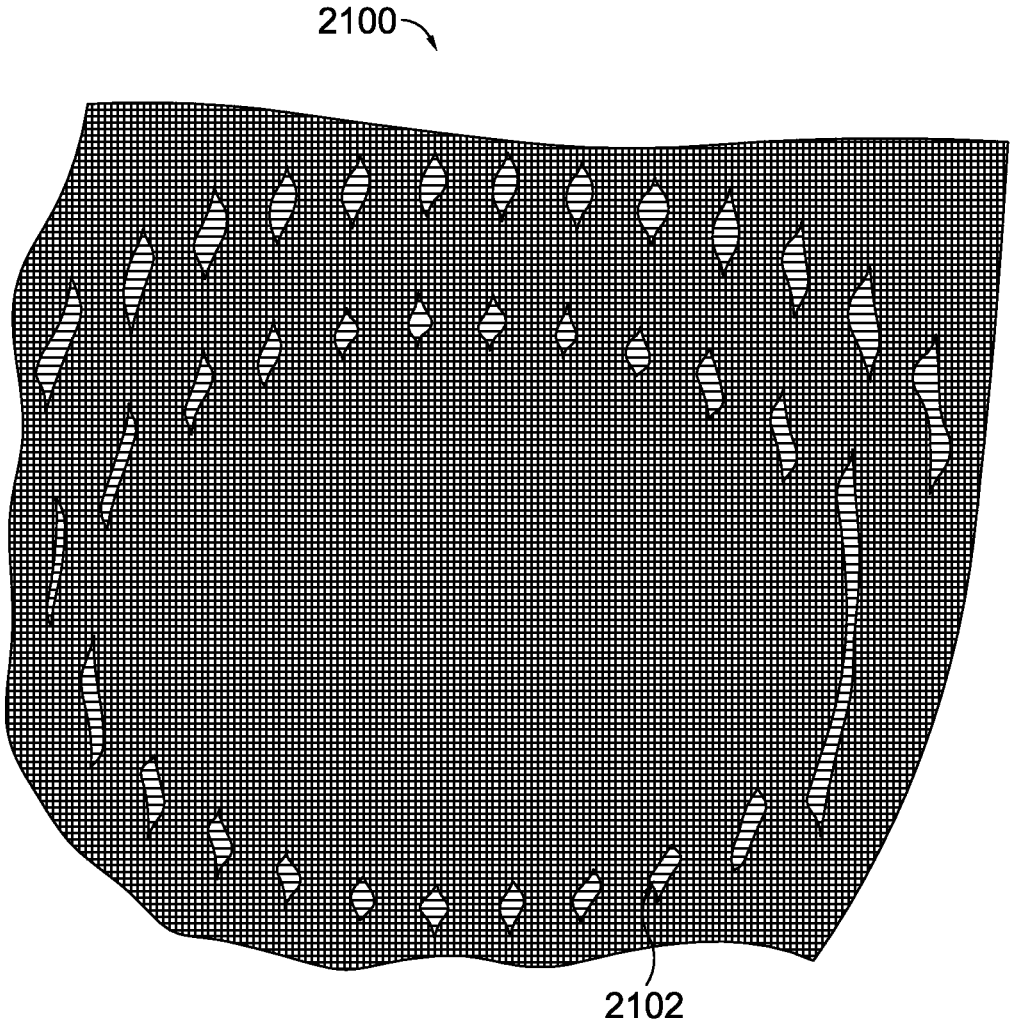
FIG. 21 depicts an exemplary woven article having a monofilament warp running in the horizontal direction and wefts running in the vertical direction, in accordance with aspects of the present invention.

FIG. 21 depicts an exemplary woven article 2100 having a monofilament warp running in the horizontal direction and wefts running in the vertical direction, in accordance with aspects of the present invention. The wefts may float in formation over the warps forming the openings 2102. It is contemplated that the openings 2102 may be formed in an location at any size and at any relative position to one another. Further, it is contemplated that the monofilament may be removed or displaced from the openings (e.g., melted). For example, a laser or other heat generating device may selectively terminate the monofilament (or any filament) within the openings to provide a clear opening through which heat, moisture, light, and the like may pass.

While embodiments provided herein refer to a substantially planar upper, it is understood that features described herein may be incorporated into articles formed in a non-substantially planar manner. For example, aspects directed to and including lockout strands may be implemented in any type of footwear or article, regardless substantial planarness.

Although the shoe construction is described above by referring to particular aspects, it should be understood that the modifications and variations could be made to the shoe construction described without departing from the intended scope of protection provided by the following claims.

The invention claimed is:

1. A woven substantially-planar shoe upper comprising:

a woven first side portion extending from a first coupling edge at a heel end towards a toe end and also extending from an upper edge towards a first side edge, the upper edge defining, in part, a forefoot opening and an ankle opening into an interior of the shoe upper portion when the shoe upper portion is formed as a non-planar shoe upper;

a woven second side portion extending from the heel end towards the toe end and also extending from the upper edge towards a second side edge, the second side portion and the woven first side portion form, in part, a medial side and a lateral side of the shoe upper portion when the shoe upper portion is formed as a non-planar shoe upper;

a woven toe region extending between the woven first side portion at the toe end and the second side portion at the toe end, the toe region also extending towards the upper edge forming a toe end of the forefoot opening;

a woven heel region extending from an ankle edge to a heel sole edge and also extending between the heel end of the second side portion and a second coupling edge; and the woven first side portion seamlessly coupled with the toe region, the toe region seamlessly coupled with the woven second side portion, and the woven second side portion seamlessly coupled with the heel region, wherein the woven first side portion, the woven second side portion, the toe portion, and the heel portion are substantially planar, wherein the woven first side portion is further comprised of a first side sole flap, the first side sole flap having a length extending between the toe region and the heel region when the shoe upper is formed in a non-planar manner; and an integrally formed stretch portion defined by a convergence of the woven first side portion and the first side sole flap, the integrally formed stretch portion having a lower modulus of elasticity than the woven first side portion, and wherein the integrally formed stretch portion increases the ease of transforming the woven substantially-planar shoe upper into a three-dimensional structure.

2. The shoe upper of claim 1, wherein a portion of the woven first side portion is formed with a first weaving technique and the integrally formed stretch portion is formed with a second weaving technique that is different than the first weaving technique.

3. The shoe upper of claim 1, wherein each of the woven first side portion and the woven second side portion is comprised of a first functional region and a second functional region, the first functional region is comprised of a material that is not utilized in the second functional region.

4. The shoe upper of claim 1, wherein the woven first side portion further comprises:

a first portion extending from proximate the upper edge toward the first side edge; and a second portion, wherein the first portion has a lower modulus of elasticity than the second portion.

5. The shoe upper portion of claim 4 further comprising a lacing mechanism, wherein the lacing mechanism is proximate the upper edge in the first portion.

6. The shoe upper of claim 1, wherein the toe region is further comprised of an integrally formed first region and an integrally formed second region, the first region having a greater modulus of elasticity than the second region.

7. The shoe upper of claim 1, wherein the heel region is comprised of a dimensional zone.

8. The shoe upper of claim 7, wherein the dimensional zone is formed, at least in part, with a weaving technique that deposits filler yarns to generate thickness at the dimensional zone.

9. The shoe upper of claim 1 further comprising:

a first sole flap extending from the woven first side portion outwardly towards a first flap edge; and a second sole flap extending from the woven second side portion outwardly towards a second flap edge.

10. The shoe upper of claim 9, wherein the first flap edge is coupled with the second flap edge and the first coupling edge is coupled with the second coupling edge forming a three dimensional article comprised of an ankle opening and a forefoot opening.

11. A woven shoe upper comprising:

a woven heel portion having an ankle edge and an opposite heel sole edge, the heel portion comprised of a dimensional portion, a stretch portion, and a non-stretch portion, the dimensional portion has a thickness greater than the stretch portion and the non-stretch portion, wherein the dimensional portion, the stretch portion, and the non-stretch portion are integrally formed;

a woven toe portion having a forefoot edge and an opposite toe sole edge, the toe portion comprised of a stretch portion and a non-stretch portion, the stretch portion and the non-stretch portion integrally formed;

a woven medial side portion extending between the heel portion and the toe portion on a medial side of the shoe upper, the woven medial side portion having a first upper edge and an opposite medial sole edge, wherein the woven medial side portion is further comprised of a first side sole flap, the first side sole flap having a length extending between the woven toe region and the woven heel region when the shoe upper is formed in a non-planar manner;

a woven lateral side portion extending between the heel portion and the toe portion on a lateral side of the shoe upper, the woven lateral side portion having a first upper edge and an opposite lateral sole edge, wherein the woven lateral side portion is further comprised of a second side sole flap, the second side sole flap having a length extending between the toe region and the heel region when the shoe upper is formed in a non-planar manner; and a first integrally formed stretch portion positioned at a convergence of the woven medial side portion and the first side sole flap, and a second integrally formed stretch portion defined by a convergence of the woven lateral side portion and the second side sole flap, wherein the first integrally formed stretch portion increases the ease of transforming the woven shoe upper into a three-dimensional structure, and wherein the first integrally formed stretch portion has a lower modulus of elasticity than the first side sole flap.

12. The shoe upper of claim 11, wherein the woven medial side portion is further comprised of a non-stretch portion extending from the medial upper edge towards the medial sole edge, the first integrally formed stretch portion having a lower modulus of elasticity than the non-stretch portion.

13. The shoe upper of claim 12 further comprising a plurality of lacing mechanisms proximate the medial upper edge, wherein the non-stretch portion of the woven medial side portion extends from each of the plurality of lacing mechanisms towards the medial sole edge.

14. The shoe upper of claim 11, wherein the heel region is seamlessly coupled with one of the woven medial side portion or the woven lateral side portion and the heel region is mechanically coupled with the other of the woven medial side portion or the woven lateral side portion.

15. The shoe upper of claim 11, wherein the medial sole edge is coupled with the lateral sole edge.

16. The shoe upper of claim 11 further comprising a breathability region proximate the toe portion.

17. A shoe construction comprising:

a sole; and an upper, the upper comprising:

(1) a medial side portion, the medial side portion comprised of:

a) a first region extending from a forefoot opening towards the sole;

b) a second region extending from the forefoot opening toward the first region, the second region having a greater modulus of elasticity than the first region;

c) a first aperture extending through the medial side portion proximate the forefoot opening within the first region;

d) a first side sole flap, the first side sole flap having a length extending between a woven toe region and a woven heel region when the shoe upper is formed in a non-planar manner; and e) a first integrally formed stretch portion defining a convergence of the woven medial side portion and the first side sole flap, wherein the first integrally formed stretch portion decreases in width measured between the first side sole flap and the woven medial side portion as it extends from the woven toe region to the woven heel region, and wherein the first integrally formed stretch portion has a lower modulus of elasticity than the woven medial side portion and the first side sole flap, such that the first integrally formed strength portion increases the ease of transforming the upper into a three-dimensional structure;

(2) a lateral side portion, the lateral side portion comprised of:

a) a third region extending from the forefoot opening towards the sole;

b) a fourth region extending from the forefoot opening toward the third region, the fourth region having a greater modulus of elasticity than the third region; and c) a second aperture extending through the lateral side portion proximate the forefoot opening within the third region;

(3) wherein the first region and the second region are integrally coupled sharing a common warp; and (4) the third region and the fourth region are integrally coupled sharing a common warp.

18. The shoe upper of claim 1, wherein the integrally formed stretch portion tapers toward the forefoot opening and the heel region of the shoe upper.

19. The shoe upper of claim 11, wherein the first integrally formed stretch portion tapers toward the forefoot opening and the heel region of the shoe upper.

20. The shoe construction of claim 17, wherein the first integrally formed stretch portion tapers toward the forefoot opening and the woven heel region of the shoe construction.

* * * * *